US007549763B2

(12) United States Patent
Kim et al.

(10) Patent No.: US 7,549,763 B2
(45) Date of Patent: Jun. 23, 2009

(54) CLOTHING ATTACHABLE LIGHT

(75) Inventors: Paul Y. Kim, Santa Ana, CA (US); Travis S. Mitchell, Aliso Viejo, CA (US); Laichang Tang, Chino Hills, CA (US)

(73) Assignee: Surefire, LLC, Fountain Valley, CA (US)

( * ) Notice: Subject to any disclaimer, the term of this patent is extended or adjusted under 35 U.S.C. 154(b) by 127 days.

(21) Appl. No.: 11/594,504

(22) Filed: Nov. 7, 2006

(65) Prior Publication Data

US 2007/0159809 A1 Jul. 12, 2007

Related U.S. Application Data

(63) Continuation-in-part of application No. 11/331,779, filed on Jan. 12, 2006.

(51) Int. Cl.
*F21V 21/84* (2006.01)

(52) U.S. Cl. ..... 362/106; 362/191; 362/396; 362/427; 248/229.12

(58) Field of Classification Search ..... 362/103, 362/105, 106, 108, 396, 190, 191, 197, 199, 362/269, 427, 457, 458; 248/229.13, 229.16, 248/231.81, 292.12, 292.13; 2/160, 209.13
See application file for complete search history.

(56) References Cited

U.S. PATENT DOCUMENTS

| | | | | |
|---|---|---|---|---|
| 1,717,386 | A | | 6/1929 | Kaplan |
| 2,506,685 | A | | 5/1950 | Sadloski et al. |
| 3,112,889 | A | * | 12/1963 | Marmo et al. ..... 362/103 |
| 4,040,547 | A | * | 8/1977 | Dickey ..... 224/247 |
| 4,092,704 | A | | 5/1978 | Malm |
| 4,186,429 | A | | 1/1980 | Johnston |
| 4,195,328 | A | | 3/1980 | Harris, Jr. |
| 4,199,802 | A | | 4/1980 | Malm |
| 4,299,344 | A | * | 11/1981 | Yamashita et al. ..... 224/242 |
| 4,406,040 | A | | 9/1983 | Cannone |
| 4,425,600 | A | | 1/1984 | Barnhart |
| 4,521,831 | A | | 6/1985 | Thayer |
| 4,648,131 | A | | 3/1987 | Kawaguchi et al. |
| 4,689,834 | A | | 9/1987 | McCarthy et al. |
| 4,760,373 | A | | 7/1988 | Reilly |
| 4,769,629 | A | | 9/1988 | Tigwell |
| 4,793,007 | A | | 12/1988 | Barnett |
| 4,862,331 | A | | 8/1989 | Hanabusa |
| 4,901,210 | A | | 2/1990 | Hanabusa |
| 4,967,323 | A | | 10/1990 | Johnson et al. |
| 5,103,384 | A | | 4/1992 | Drohan |
| 5,183,324 | A | | 2/1993 | Thomas |
| 5,284,345 | A | * | 2/1994 | Jehn ..... 473/209 |
| 5,327,588 | A | | 7/1994 | Garneau |

(Continued)

OTHER PUBLICATIONS

Wikipedia Contributors, "Molle", Wikipedia, The Free Encyclopedia, Jun. 15, 2006. http://www.wikipedia.org/wiki/MOLLE (Jun. 28, 2006).

*Primary Examiner*—Sandra L. O'Shea
*Assistant Examiner*—Gunyoung T. Lee
(74) *Attorney, Agent, or Firm*—David Weiss

(57) ABSTRACT

A light adapted for attachment to an article of clothing such as a strap of an assault or MOLLE vest. A preferred light embodiment includes a clip for removable attachment to the strap, and a light body removably securable to a docking base pivotally secured to the clip.

19 Claims, 17 Drawing Sheets

U.S. PATENT DOCUMENTS 5,331,684 A 7/1994 Baril et al.
5,367,408 A 11/1994 Corsan et al.
5,408,393 A 4/1995 Becker
5,410,457 A 4/1995 Parker
5,426,792 A 6/1995 Murasko
5,460,346 A * 10/1995 Hirsch ..... 248/229.13
5,479,325 A 12/1995 Chien
5,485,358 A 1/1996 Chien
5,488,361 A 1/1996 Perry
5,608,919 A 3/1997 Case
5,648,862 A 7/1997 Owen
5,658,065 A 8/1997 Jamieson
5,664,868 A 9/1997 Montalbano et al.
5,667,292 A 9/1997 Sabalvaro, Jr.
5,738,432 A * 4/1998 Okko et al. ..... 362/103
5,755,367 A 5/1998 Yamada
5,758,947 A 6/1998 Glatt
5,853,242 A 12/1998 Bouffay et al.
5,871,272 A 2/1999 Sharrah et al.
5,893,630 A * 4/1999 Mosquera ..... 362/191
5,910,764 A 6/1999 Hayden
6,022,119 A 2/2000 Booty, Jr.
6,095,657 A 8/2000 Kent
6,113,244 A 9/2000 Baumgartner
6,206,543 B1 3/2001 Henry
6,213,619 B1 * 4/2001 Yu ..... 362/103
6,315,426 B1 11/2001 Buller, Jr.
6,388,390 B2 5/2002 Rachwal
6,439,733 B1 8/2002 Fischer et al.
6,464,369 B1 10/2002 Vega et al.
6,467,929 B2 10/2002 Lee
6,616,294 B1 9/2003 Henry
6,619,813 B1 * 9/2003 Schnell ..... 362/116
6,648,489 B2 11/2003 Fischer et al.
6,686,837 B2 2/2004 Kim
6,721,962 B1 4/2004 Polaire
6,738,130 B1 5/2004 Chen
6,752,299 B2 * 6/2004 Shetler et al. ..... 224/197
6,752,510 B1 6/2004 Appiah
6,764,194 B1 * 7/2004 Cooper ..... 362/105
6,877,875 B2 4/2005 Yu et al.
6,905,223 B2 6/2005 Halasz
6,953,259 B2 * 10/2005 Parsons et al. ..... 362/191
7,021,789 B2 4/2006 Dalton et al.
7,040,783 B1 * 5/2006 Christianson ..... 362/396
7,048,403 B2 5/2006 Parker et al.
7,070,295 B1 * 7/2006 Lee ..... 362/191
2003/0227773 A1 * 12/2003 Yang ..... 362/199
2005/0174753 A1 8/2005 Cao et al.

* cited by examiner

CLOTHING ATTACHABLE LIGHT

CROSS-REFERENCE TO RELATED APPLICATION

This application is a continuation-in-part of U.S. patent application Ser. No. 11/331,779, filed Jan. 12, 2006, incorporated in full herein by reference

BACKGROUND OF THE INVENTION

The present invention pertains to mountable light assemblies, and more particularly to a light body in combination with a mount that may be removably attached to an article of clothing.

Lights adapted to be mounted on articles of clothing are known. What has not been previously known is a mount removably securable to an article of clothing and on which a light can be readily removed or attached with one hand in a substantially continuous motion. Also not taught in the prior art is the ability to complete such attachment and removal without visual reference while the mount is secured to the article of clothing. There has also been a need for a clothing mounted device that allows a light mounted thereon to be rapidly and rigidly adjusted to a particular orientation.

SUMMARY OF THE INVENTION

According to an aspect of the present invention, a clothing attachable light includes a mount assembly and a light body. A preferred embodiment of the mount assembly comprises a clip for attachment to the article of clothing and a docking base pivotally secured to the clip. The docking base is adapted to receive the light body, such as disclosed in parent U.S. patent application Ser. No. 11/331,779 filed Jan. 12, 2006 ("the '779 application") assigned to the assignee of the present invention and incorporated herein by reference. The docking base is adapted to engage the clip in such manner that the docking base (and the hence light body) may be held by the clip in selected alternative orientations.

The clip includes at least one and preferably two pairs of legs, each pair including a first leg and a second leg substantially opposite one another and joined together at one end of the legs and open at the other end of the legs. The first leg and second leg are substantially parallel to one another along their opposed lengths.

The first leg and second leg are attached to an article of clothing by sliding the open end of the legs over a portion of the clothing. The first leg and second leg are held in place on the clothing by compressive action of the first leg and second leg against the clothing that resides between the first leg and second leg. The first leg and second leg may also be kept attached to the clothing by a catch that one or both of the first leg and second leg may have at the open end of the leg or legs. One or both of the first leg and second leg may also have a ramp or taper at the open end of the leg or legs to facilitate sliding the legs onto an article of clothing. Once the first and second legs are slid onto an article of clothing, the catch will keep the legs attached to the clothing even if the legs are not compressing the article of clothing in any manner.

In a preferred embodiment, the article of clothing is an assault vest such as a MOLLE vest (MOdular Lightweight Load-carrying Equipment) having PALS (Pocket Attachment Ladder System) webbing straps stitched into the vest at regular intervals. The first leg and second leg are attached to such a webbing strap. This preferred embodiment is also suitable for attachment to other articles of clothing such as belts, jackets, shirts, pants, headgear, straps, waistbands, footwear and the like. As used herein, straps are articles of clothing and include straps that are integral with another article of clothing, straps attached separately to an article of clothing, and straps that are worn directly by the user such as a watch strap, arm strap, leg strap, or chest strap.

In a preferred embodiment, the mount includes a pivot assembly extending from the area where the single pair or both pairs of legs are joined. The preferred pivot assembly includes a first bracket spaced apart from and opposite a second bracket. The first and second brackets each include a hole, each such hole opposing and aligned with the other such hole, and each such hole preferably having a non-circular shape such as evenly spaced scallops forming the perimeter of the hole or a square hole. A fixed adjustment ring is adapted to fit inside each such hole.

Each fixed adjustment ring has, preferably, radially spaced, alternating ridges and valleys for engaging, respectively, corresponding valleys and ridges on a rotating adjustment ring. Each rotating adjustment ring resides in one end of a mounting arm while the other end of such mounting arm is attached to the docking base. Each fixed adjustment ring preferably has a hole for receipt of a pivot pin. The pivot pin is held in place on one end by a pin head and on the other end by a pin nut.

In a preferred embodiment, the docking base includes two arms substantially extending parallel to one another. A spring, preferably carried by the pivot pin between the pair of extending arms, has a spring force that tends to bias the arms away from one another.

As disclosed in the '779 application, a light body attaches to the docking base and provides one or more of the following in any combination: a visible light source, a night vision light source that may be in the visible or invisible range, and/or an IFF light source. The light body includes a battery housing for a battery comprising at least one battery cell for supplying power as needed to energize the light sources.

As also disclosed in the '779 application, the docking base serves as a quick-release platform upon which a light body can be quickly and rigidly attached and quickly removed. The docking base includes attachment channels that engage complementary attachment rails that are part of the light body. The docking base also includes a quick-release lever that has a latch and a quick-release button. The latch engages a catch or slot on the light body to keep the light body attached to the docking base.

When a user depresses the quick-release button, the latch is disengaged from the slot, thereby allowing the light body to be removed from the docking base by a simple sliding motion. The quick-release lever is resilient and the latch is preferably tapered, so that together they act to allow the latch to automatically reengage the catch when the light body is slid back onto the docking base.

The light body typically includes a visible light source, a night vision light source, and an IFF light source. The night vision light source preferably provides light such as invisible infrared, but may instead be a visible red light that is compatible with night vision devices while providing low level area illumination. In the preferred embodiment, LED's are the light sources because of their low power consumption and long life. The visible light source and the night vision light source are typically controlled by a single three-position switch that either activates (1) only visible lighting, (2) only night vision lighting, or (3) neither. The IFF light source is typically controlled by a separate, dedicated on/off switch.

The light body of the preferred embodiment is also provided with a brightness control for varying the brightness of the visible light.

Accordingly, the present invention provides a light comprising: a mount assembly attachable to an article of clothing, the mount assembly including a docking base adapted to lockably engage a light body; and a light body adapted to lockably engage the docking base, the light body including at least one light source. In the preferred embodiment, the mount assembly includes a clip removably attachable to the article of clothing, the docking base secured to the clip preferably by a pivot assembly pivotally securing the docking base to the clip in a selected one of a plurality of alternative fixed orientations.

The light of the preferred embodiment of the present invention is of particular utility for attachment to an assault vest such as a MOLLE vest having a strap secured therealong.

A preferred embodiment of the mount assembly according to the present invention, for mounting a light body to an article of clothing, comprises: a clip including at least one and preferably two pairs of legs removably attachable to an article of clothing such as a MOLLE vest; a pivot assembly including two opposed brackets secured to the clip, two fixed adjustment rings respectively in the brackets, and a pivot pin extending between the fixed adjustment rings; a docking base adapted to lockably engage the light body, the docking base including two opposed arms each including an adjustment ring cooperatively configured to the fixed adjustment rings and pivotally mounted to the pivot pin; and a spring carried by the pivot pin for biasing the arms away from one another.

A preferred manner of attaching a light to an article of clothing, in accordance with the present invention, comprises: providing an article of clothing with a strap secured therealong; providing a mount assembly including a clip and a docking base; providing a light body including at least one light source; placing the article of clothing for being worn by a user with the clip attached to the strap; the user grasping the light body with one hand and, in a substantially continuous motion of that one hand, aligning the light body with the docking base, sliding the light body onto the docking base, and releasably locking the light body to the docking base. For removing the light body from the docking base, the user may grasp the light body with one hand and, in a substantially continuous motion of that one hand, unlock the light body from the docking base and slide the light body off the docking base.

BRIEF DESCRIPTION OF THE DRAWINGS

The novel features characteristic of the invention, both as to structure and method of operation thereof, together with further advantages thereof, will be understood from the following description, considered in connection with the accompanying drawings, in which the preferred embodiment of the invention is illustrated by way of example. In FIGS. 1-9, the views are referenced to a front view, FIG. 1, that looks directly into any one of five light sources located in the light body. In this front view orientation, a beam of light from such a light source would be normal to the plane of the drawing sheet of FIG. 1 and would flow from the plane of the drawing sheet toward the viewer. In FIGS. 10-32, the views are referenced to front views, FIGS. 10 and 11, where the docking base is in such a position that when a light body is mounted on the docking base, a beam of light from the light body would be parallel to the plane of drawing sheet and would flow from the light body to the bottom of the drawing sheet. It is to be expressly understood, however, that the drawings are for illustration and description only and not as a definition of the limits or scope of the invention.

FIG. 1 is a front view of a preferred embodiment of a light assembly according to the invention disclosed in parent patent application Ser. No. 11/331,779, installed on the brim of a helmet as worn by an individual;

FIG. 2 is a front view of the preferred light of FIG. 1 shown in increased scale as mounted on the brim of a helmet;

FIG. 3 is a perspective view of the preferred light embodiment of FIG. 2;

FIG. 4 is a side elevation view of a mount assembly included in the light of FIG. 2;

FIG. 5 is a sectional view of the mount assembly of FIG. 4 taken along the line 5-5 and viewed in the direction of the appended arrows;

FIG. 6 is an exploded perspective view of the docking base and resilient pad of the mount assembly;

FIG. 7 is a perspective view of the helmet mounting bracket of the mount assembly of FIG. 5;

FIG. 8 is a rear perspective view of the light body of the light of FIG. 2;

FIG. 9 is a top view of the light of FIG. 2;

FIG. 10 is a front view of a preferred embodiment of a mount assembly according to the instant invention secured to an article of clothing, specifically to a MOLLE vest;

FIG. 11 is a front view of a preferred embodiment of a light assembly secured to the vest of FIG. 10, including the light body of FIG. 8 secured to the mount assembly of FIG. 10;

FIG. 12 is a view of the mount of FIG. 10 shown in isolation and in increased scale;

FIG. 13 is a perspective view of a mount of FIG. 10;

FIG. 14 is a perspective view of a preferred docking base with mounting arms and rotatable adjustment rings according to the instant invention;

FIG. 15 is a side view of a mount of FIG. 10 attached to a strap, shown in dashed-line cross-section, attached to the front of a vest shown in part, in a dashed line;

FIG. 16 is a bottom view of the mount of FIG. 10;

FIG. 17 is a top view of the mount of FIG. 10;

FIG. 18 is a back view of the mount of FIG. 10;

FIG. 19 is a perspective view of a preferred embodiment of the clip and brackets of the instant invention;

FIG. 20 is a cross-sectional view of the pivot pin, pin head, fixed adjustment ring, and rotatable adjustment ring taken along line 20-20 of FIG. 16 and viewed in the direction of the appended arrows;

FIG. 21 is a perspective view in increased scale of a fixed adjustment ring according to the instant invention;

FIG. 22 is an isolated front view in increased scale of the preferred light assembly embodiment of the instant invention shown in FIG. 11;

FIG. 23 is a side view of the light assembly of FIG. 22;

FIG. 24 is a top view of the light assembly of FIG. 22;

FIG. 25 is a bottom view of the light assembly of FIG. 22;

FIG. 26 is a view of the light assembly of FIG. 23 where the docking base and light body have been rotated to a position to direct light from the light body forwardly and downwardly at a first predetermined angle or increment below horizontal;

FIG. 27 is a perspective view of the light assembly shown in FIG. 26;

FIG. 28 is a side view of the mount of the instant invention where the docking base has been rotated to a vertical orientation;

FIG. 29 is a side view of the mount of the instant invention where the docking base has been rotated to a horizontal orientation;

FIG. 30 is a side view of the mount of the instant invention where the docking base has been rotated to a position forwardly and downwardly at a predetermined angle or increment below horizontal; and FIG. 31 is a side view of the mount of the instant invention where the docking base has been rotated to position forwardly and downwardly at another predetermined angle or increment below horizontal as in FIG. 26.

DETAILED DESCRIPTION OF THE PREFERRED EMBODIMENT

In the following description, a specific arrangement, construction, and other details are set forth in order to provide a more thorough understanding of the instant invention. It will be apparent to those skilled in the art that the instant invention may be practiced without these specific details and that other embodiments are within the scope of the instant invention.

Figure 1:
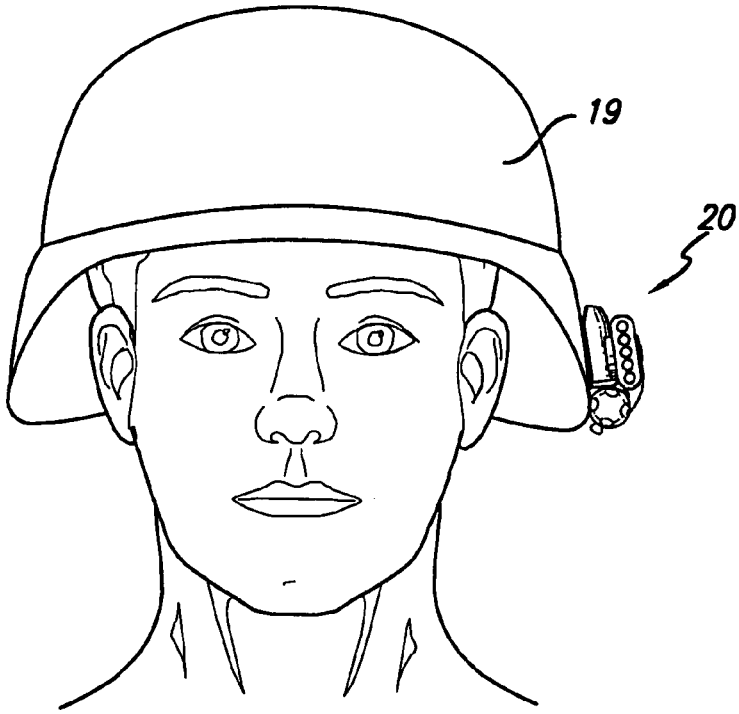
FIGS. 1-9 were previously shown in the '779 application.
Figure 2:
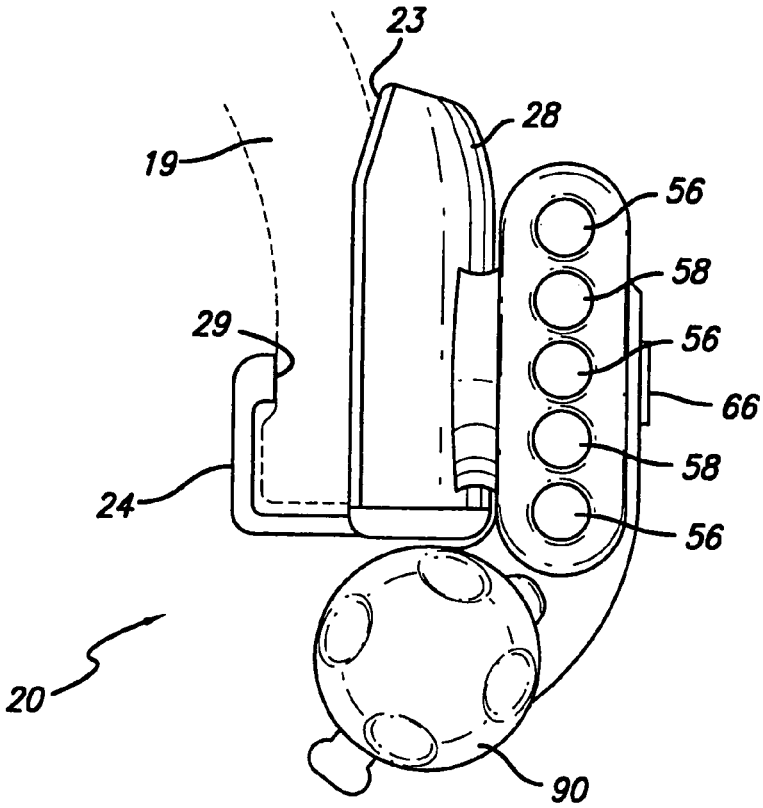
Figure 3:
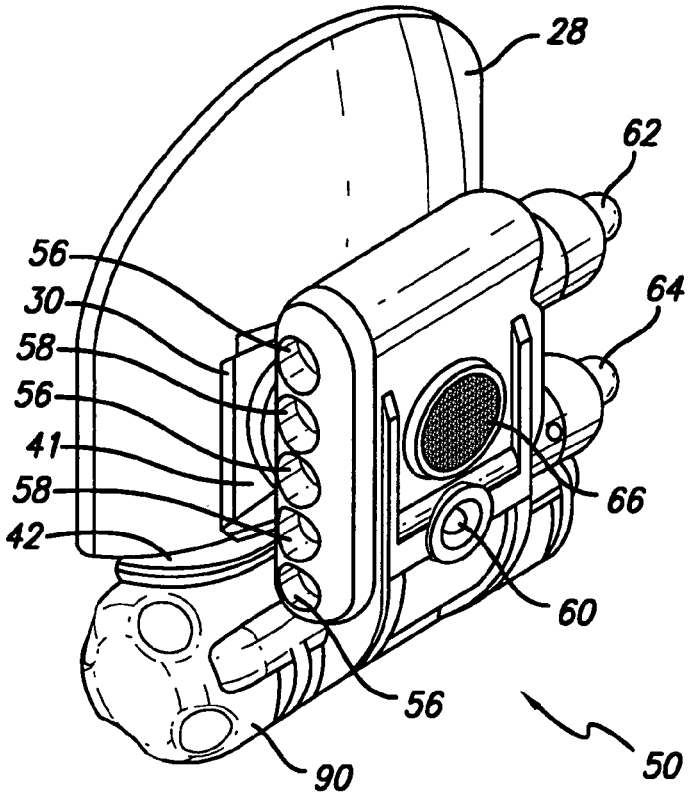

FIGS. 1-9 show a preferred embodiment of a light apparatus or light 20 of the invention taught in the parent application Ser. No. 11/331,779. FIG. 1 shows an individual wearing a helmet 19 with a light 20 of the present invention mounted on the helmet. As best seen in FIGS. 4, 5, 6, and 7, the preferred embodiment of the light 20 includes a mount assembly 22 comprising a mounting bracket 24 with mounting prongs 29 spaced from an opposing plate 21, mounting screws 26 threaded through threaded apertures in the opposing plate 21, a docking base 30, and a resilient pad 28. The resilient pad 28 is preferably of an elastomeric material such as neoprene, and has a contact surface 23 that contacts the outer surface of a helmet 19 or headgear. In an alternative embodiment, the resilient pad 28 is optional and need not be included in the mount assembly 22.

FIG. 1 shows the overall size of the preferred embodiment of the light 20. In this preferred embodiment, the overall size is less than 2.5 inches by 2.5 inches by 1.5 inches. This size is well-suited for achieving an objective of the invention taught in the '779 application which is to provide a helmet-mountable light that can be readily installed to or removed from a helmet or other headgear with only one hand and without visual reference.

Figure 5:
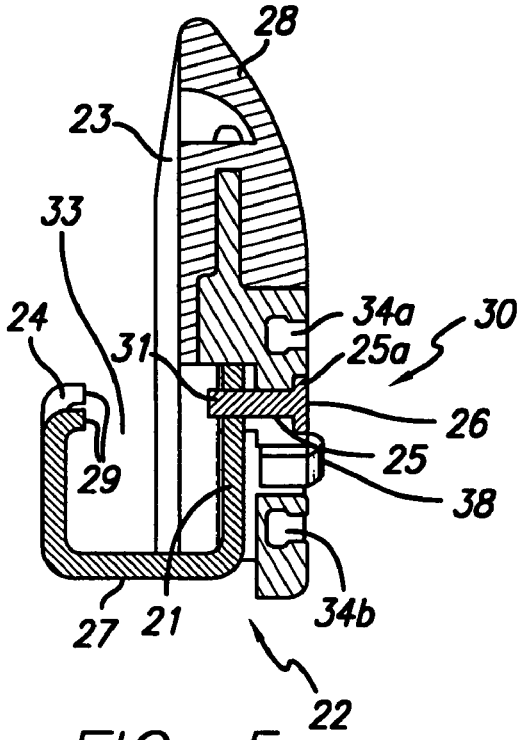
Figure 6:
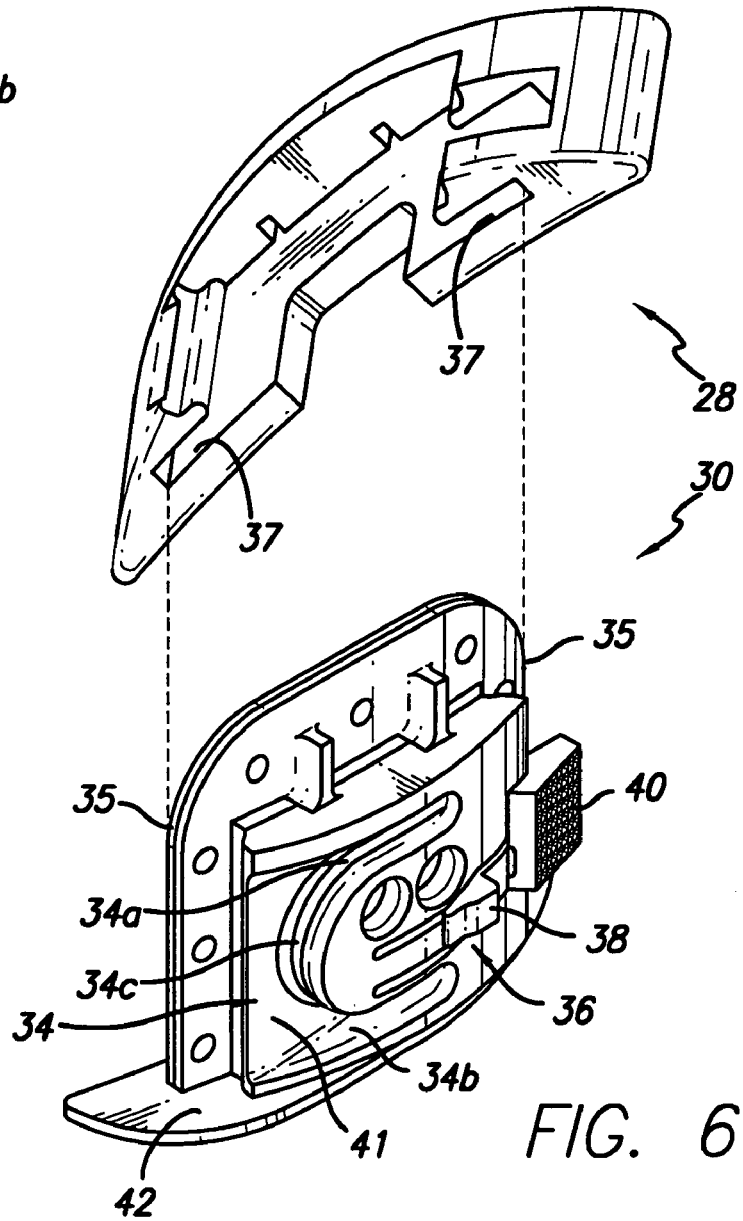
Figure 7:
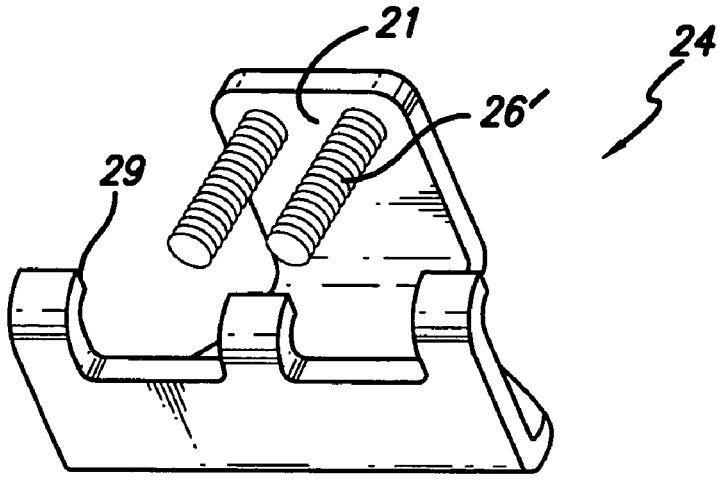
Figure 8:
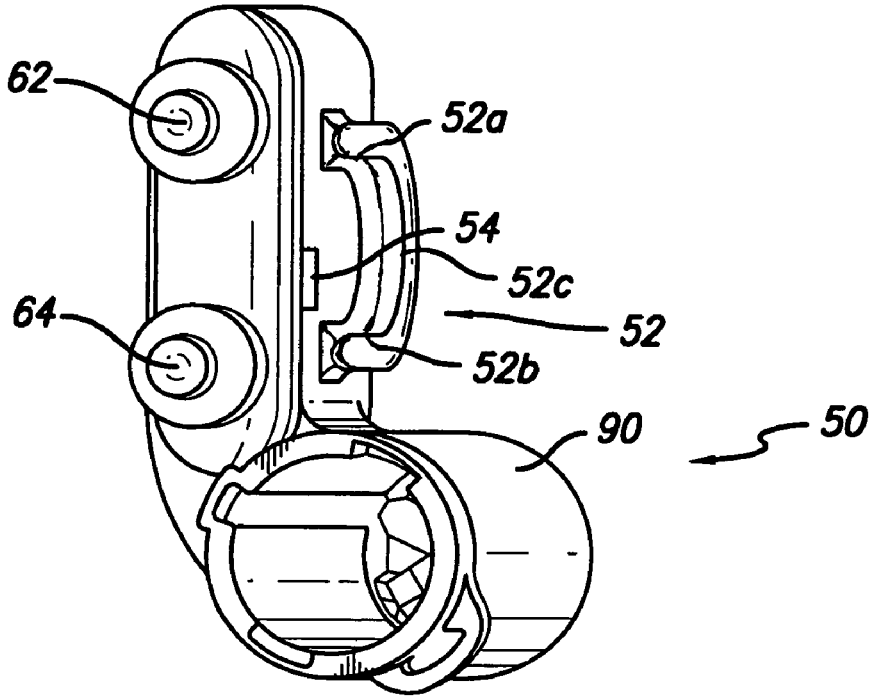

As shown in FIG. 5, in the preferred embodiment the headed attachment screws 26 attach the docking base 30 to the opposing plate 21 of the mounting bracket 24, the screws 26 extending through bores 25 in the docking base 30 with the screw heads restrained by the annular ledge of the counterbores 25*a*. The docking base 30 and the resilient pad 28 are secured together, with portions 35 of the docking base 30 being fitted into slots 37 in the pad 28 (FIG. 6). The screws 26 are short enough so that they do not contact the helmet 19 in this embodiment, and the gap 33 between the mounting prongs 29 and the pad contact surface 23 produces a loose fit with the helmet 19 when the mount assembly 22 is applied to the helmet 19. It may be appreciated that tightening of the screws 26 into the threaded apertures 31 of the plate 21 pulls the prongs 29 against the inner surface of the helmet 19. Further tightening of the screws 25 urges the docking base 30 and its secured resilient pad 28 inwardly toward the helmet 19, compressing the secured resilient pad 28 against the outer surface of the helmet 19 and clamping the helmet 19 between the prongs 29 and the pad 28. In this manner, the mount assembly 22 is securely mounted to the helmet 19 or other headgear.

To install the preferred embodiment of the mount assembly 22 on the helmet 19, a user pushes the mount assembly 22 onto the brim of the helmet 19 with the triangularly arranged bracket prongs 29 facing the inner surface of the helmet 19 and the resilient pad's contact surface 23 facing the helmet's outer surface, and with the lower bracket portion 27 facing and preferably engaging the edge of the helmet's brim. The user thereupon tightens the screws 26 as described above, securing the mount assembly including the docking base 30 to the helmet 19.

The resilient nature of the resilient pad 28 allows it to compressively fit differing helmet 19 or other headgear thicknesses, as well as to accommodate irregularities in the outer surface of the helmet 19 or other headgear. This resilient nature further enables the resilient pad 28 to conform to differing curvature due to differing mounting locations or differing sizes of helmet 19 or other headgear.

To install an alternative embodiment of the mount assembly 22 having screws 26' that are long enough to contact the helmet 19 or headgear, the mount assembly 22 is installed by first loosening the screws 26' until the distance between the mounting prongs 29 and the tips of the screws 26' is large enough to clear the brim of the helmet 19. The mount assembly 22 is then pushed onto the brim of the helmet 19 with the prongs 29 facing the helmet's inner surface and the ends of the screws 26' facing the helmet's outer surface, with the lower bracket portion 27 facing and preferably engaging the edge of the brim. The screws 26' are then tightened until they contact the helmet's outer surface, forcing the prongs 29 against the helmet's inner surface and clamping the mount assembly 22 to the helmet 19. In this alternative embodiment, the securement function of the resilient pad 28 is decreased, and the resilient pad may be omitted from this embodiment if desired.

Figure 4:
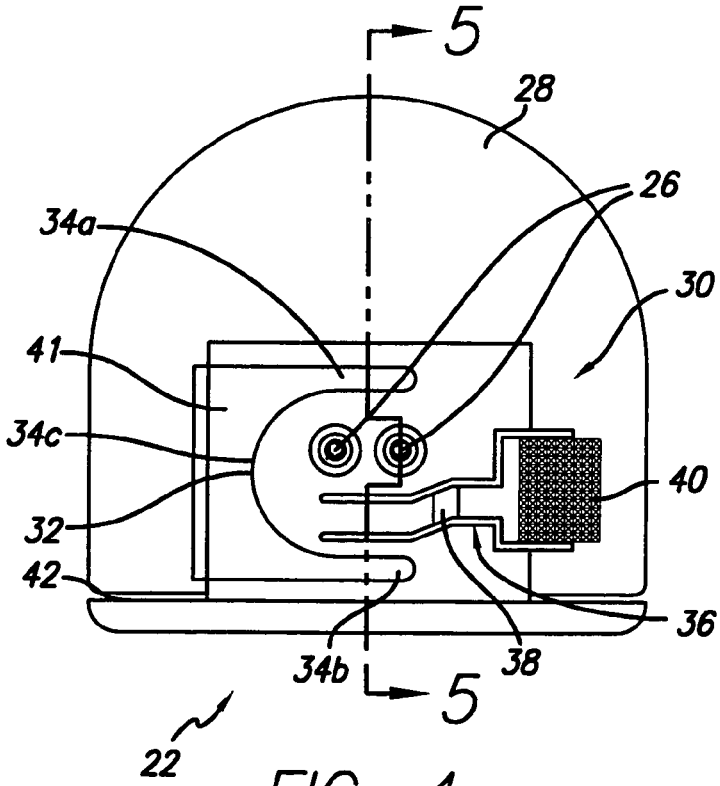

The docking base 30, best seen in FIGS. 4, 5, and 6, includes a first attachment device for cooperating with a second attachment device on the light body 50, for quickly and rigidly installing the light body 50 on the docking base 30 and for quickly removing the light body 50 therefrom. In the preferred embodiment, the docking base attachment device includes an attachment guide 32, an attachment channel 34, and a quick-release latching lever 36 with latch 38 and quick-release button 40. A "vertical" landing area 41 and a "horizontal" landing area 42 may also be included in the docking base 30.

The preferred attachment device of the light body 50, for rigidly attaching the light body 50 to the docking base 30, includes an attachment rail 52 on the light body 50 that engages the attachment channel 34 in the docking base 30. The attachment rail 52 comprises two parallel spaced-apart attachment rails 52*a* and 52*b* that are joined together at one end with a continuous U-shaped rail 52*c* and that are open at their other end.

The attachment channel 34 comprises two parallel spaced-apart attachment channels 34*a* and 34*b* joined together at one end with a continuous U-shaped channel 34*c* and that are closed at their other end. Once the attachment rails 52 are fully engaged with the attachment channels 34, the light body 50 is held in full engagement by the latch 38 that automatically engages a catch or slot 54 in the light body 50. Once the latch 38 has automatically engaged the slot 54, the light body 50 is in locked engagement with the docking base 30.

In the preferred embodiment, the light body 50 has a visible light source 56, e.g., a high luminous flux LED, a night vision light source 58, e.g., an invisible infrared LED or a visible red LED, and an IFF light source 60. A single three-position toggle switch 62 typically controls the visible light source 56 and the night vision light source 58. A separate switch 64 typically controls the IFF light source 60.

For security purposes, the IFF light source 60 is preferably invisible but may be of any color and may blink at any frequency or in any pattern. Such blinking constitutes an intermittent operation and the interval and duration of intermittence may be varied in any manner to achieve any desired blinking pattern.

In the preferred embodiment, a brightness control button 66 controls the brightness of the visible light source 56. Each instance of depressing the brightness button 66 activates, in fixed sequence, one of three levels in a brightness cycle, namely, low, medium, and high. The visible light source 56, night vision light source 58, and IFF light source 60 are all typically powered by a single battery, e.g., a 3 volt lithium battery, carried in the light body 50.

Once the mount assembly 22 is secured to the brim of the helmet 19, preferably along a side of the helmet 19, an individual wearing the helmet 19 can readily install the light body 50 on, or remove the light body 50 from, the mount assembly 22 in a substantially continuous one-handed motion, using the hand at the same side of the helmet on which the mount assembly 22 is mounted. An individual can complete such installation and removal of the light body 50 in total darkness without the need to make any visual contact with the light 20 or the helmet 19.

To install the light body 50 on the mount assembly 22, the light body 50 is held in one hand and the attachment rails 52 are aligned with the attachment channels 34. The battery housing 90 may assist the user in orienting the light body 50 so that the attachment rails 52 are roughly aligned with the attachment channels 34.

The U-shaped guide 32*c* of the attachment channels 34 acts as an automatic self-centering mechanism to ensure easy engagement of the attachment rails 52 with the attachment channels 34. This U-shaped guide 32*c* is large enough so that a user can locate it by feel with a single hand and without the need for visual reference or assistance. A "vertical" landing area 41 and a "horizontal" landing area 42 are both located near the U-shaped guide 32*c* and each such area provides a tactile reference point that can assist the user in properly aligning the attachment rails 52 with the attachment channels 34.

Once the user aligns the attachment rails 52*a*, 52*b* with the attachment channels 34*a*, 34*b*, the light body 50 can then be installed on the docking base 30 by simply pushing the light body 50 toward the quick-release button 40 (i.e., in a rearward direction) until the light body 50 can be pushed no further. The light body 50 is stopped from making contact with the quick-release button 40 because the attachment rails 52 are prevented from further movement by the presence of the U-shaped rail 52*c* coming into contact with the U-shaped channel 32*c*. The light body 50 is further stopped from making contact with the quick-release button 40 because the attachment rails 52 are prevented from further movement by the presence of the closed end of the attachment channels 32*a* and 32*b*. As the light body 50 reaches this position, the light body 50 trips the latch 38 of the resilient latching lever 36 to engage the catch or slot 54, automatically and releasably locking the light body 50 to the docking base 30.

As previously noted, the latch 38 and quick-release button 40 are both located on the quick-release latching lever 36 that is part of the docking base 30. The quick-release lever 36 is resilient so that when the quick-release lever 36 is operated, the quick-release lever 36 automatically returns toward the position it was in prior to being actuated. The latch 38 is tapered so that as the light body 50 is pushed onto the docking base 30, the light body 50 moves across the taper of the latch 38 thereby displacing the latch 38.

When the light body 50 reaches the point where the attachment rails 52 fully engage the attachment channels 34, the catch or slot 54 on the light body 50 is then in a position such that the latch 38 automatically springs into engagement with the slot 54. This engagement keeps the light body 50 rigidly attached to the docking base 30 and, in turn, the mount assembly 22. The taper of the latch 38 and the raised position of the latch 38 in its normal state can be seen in FIGS. 4 and 6.

The latch 38 is disengaged from the slot 54 by depressing the quick-release button 40 and simultaneously sliding the light body 50 in a direction away from the quick-release button 40. Depressing the quick-release button 40 causes the latch 38 to move away from the slot 54 until the latch 38 is completely clear of the slot 54. At this point, the light body 50 can be pulled free and clear of the docking base 30.

Figure 9:
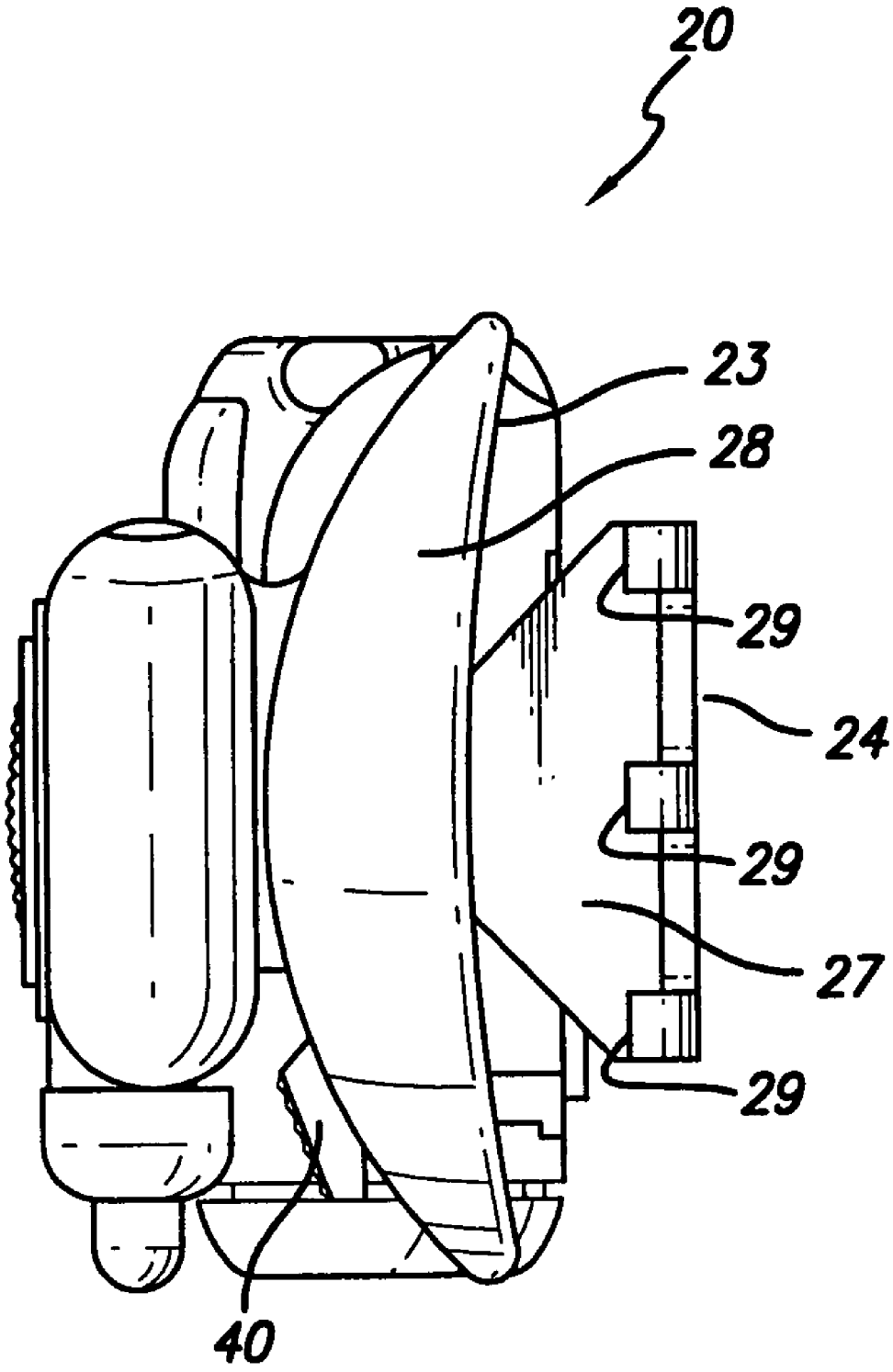

The location of the quick-release button 40 with respect to the light body 50 and mount assembly 22 is best seen in FIG. 9. It may be appreciated that, to remove the light body 50 from the docking base 30, the user may grasp the light body with one hand while, with the thumb or a finger of the same hand, simultaneously depress the quick-release button 40 and slide the light body 50 forward along the channels 34*a*, 34*b* of docking base 30 until the light body 50 is removed from the docking base 30.

Figure 10:
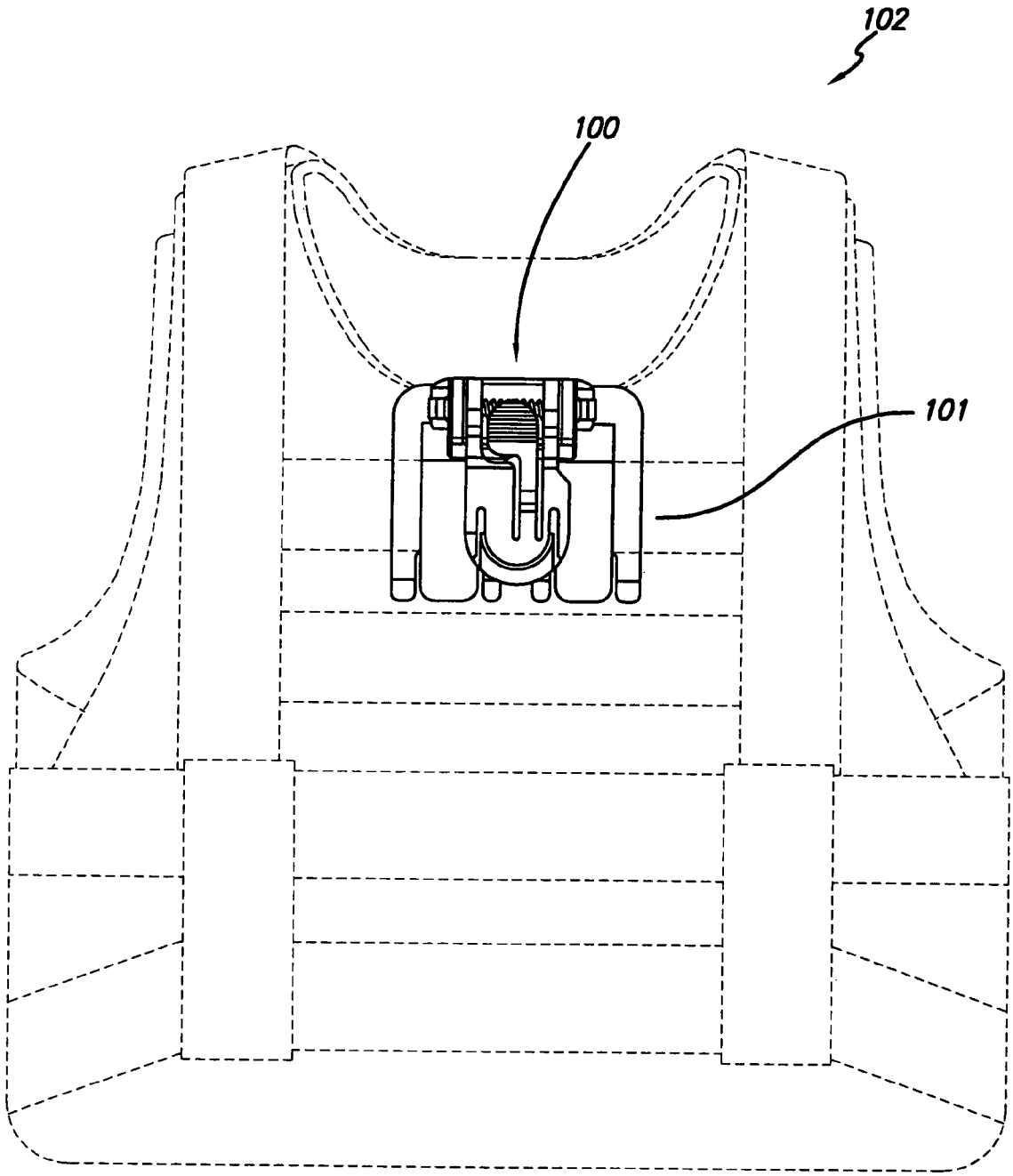
Figure 11:
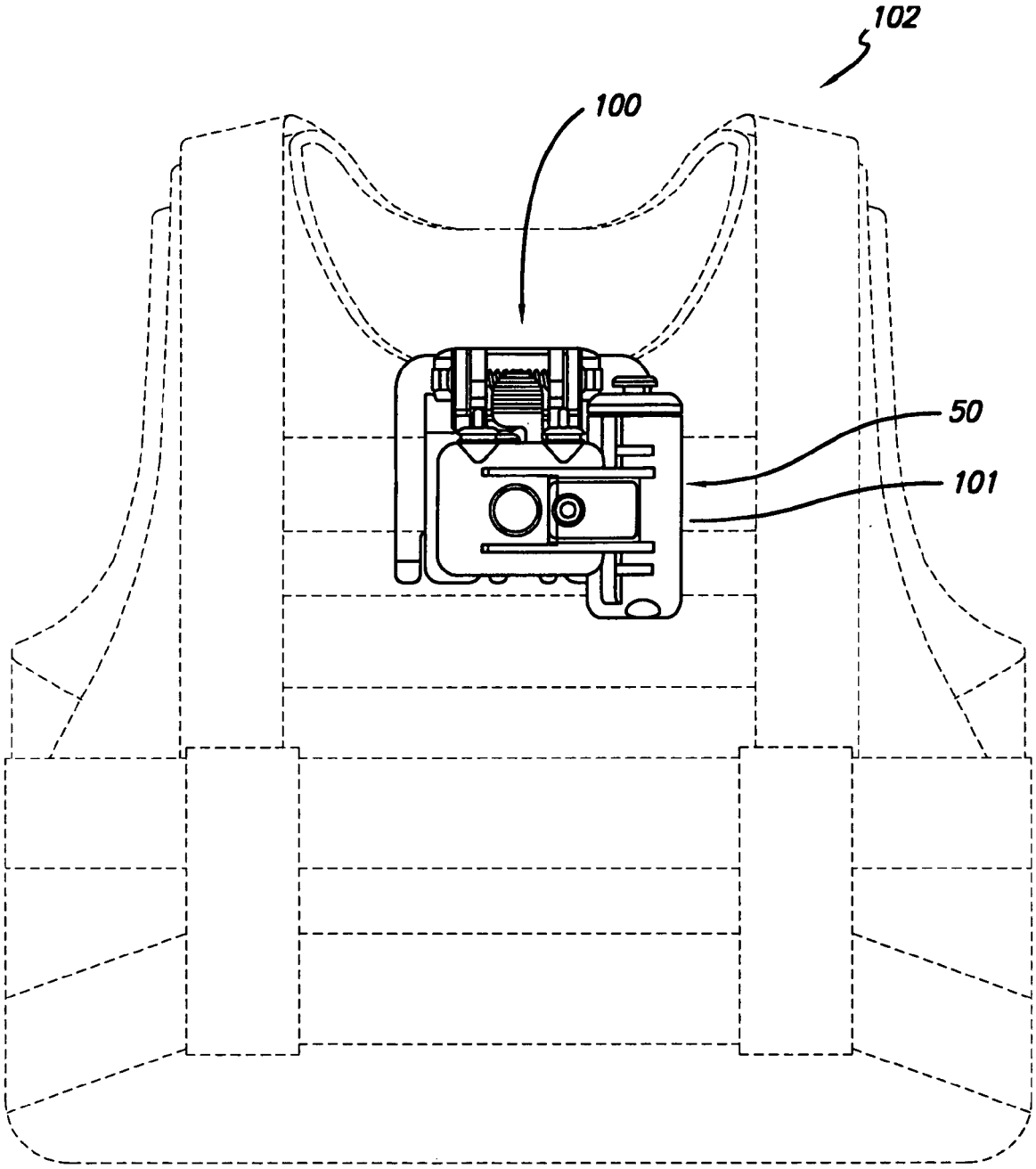
Figure 12:
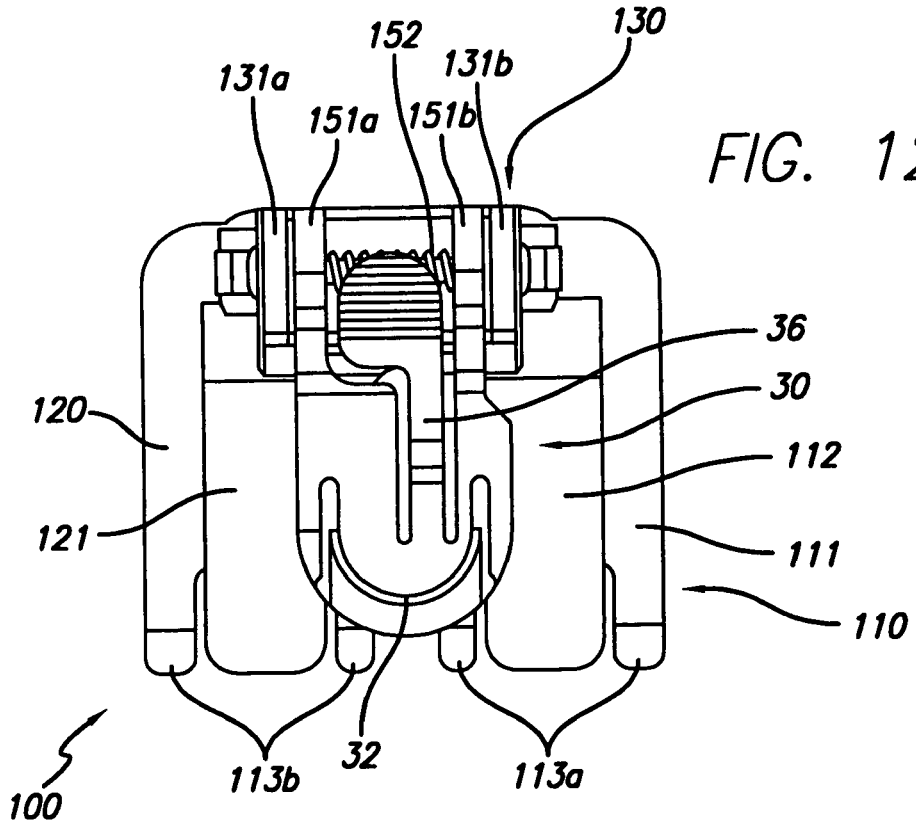
Figure 13:
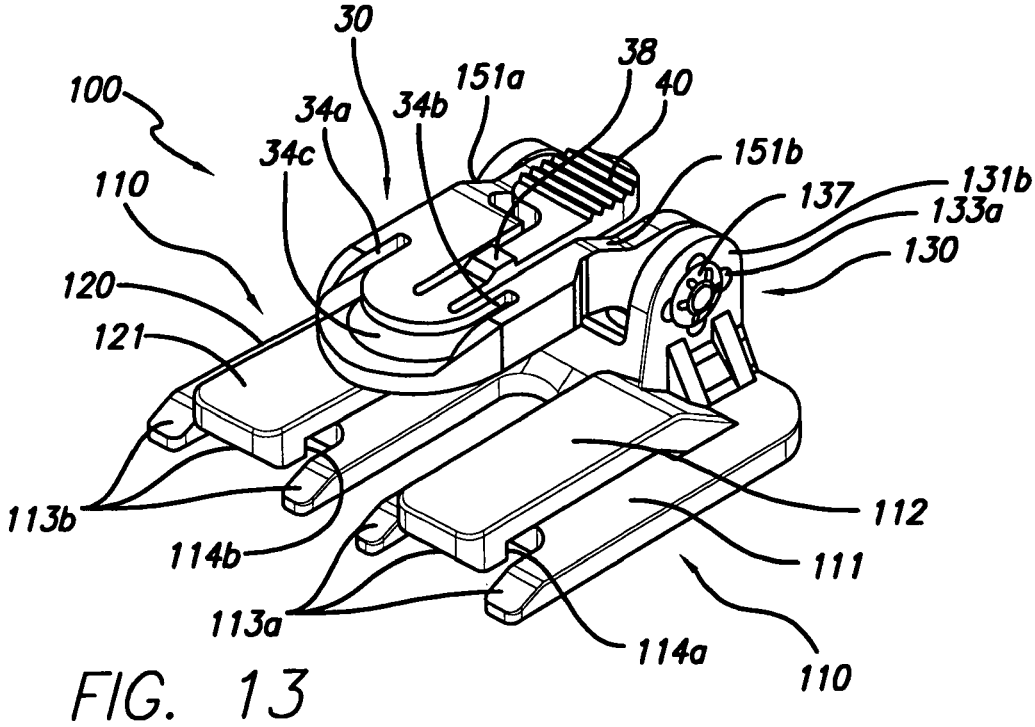

FIGS. 11 and 22-27 show a preferred embodiment of a light according to the instant invention comprising a mount 100 and a light body 50 mounted thereon. FIG. 10 shows the mount 100 mounted to an article of clothing such as a strap 101, shown in dashed lines, stitched to an assault vest 102 also shown in dashed lines, often referred to as a MOLLE vest. As best seen in FIG. 13, the mount 100 comprises a clip 110, a pivot assembly 130 extending from the clip 110, and a docking base 30 extending from the pivot assembly 130.

The clip 110 comprises at least one pair of legs having a first leg 111 and a second leg 112. The first leg 111 and second leg 112 are substantially parallel to one another and attached to one another at one end and unattached at the opposite end thereof. At the unattached end of a preferred embodiment, one of the first leg 111 and second leg 112 has a taper 113*a* while the other of the first leg 111 and second leg 112 has a taper 113*a* and is also formed into a catch or tang 114 at this unattached end. The taper 113*a* facilitates sliding the legs 111, 112 over the portion of clothing on which the mount 100 is desired to be mounted.

The legs 111, 112 remain attached to a portion of clothing in one of three ways. The first such way is by a pinching action or compressive force applied to the clothing by the action of a user wedging the clothing portion between the first leg 111 and second leg 112. The second such way is by allowing a portion of clothing to loosely fit between the first leg 111 and second leg 112 while the legs 111, 112 are held in place on the clothing by the tang 114*a*. The third such way is a combination of the first and second ways.

In a preferred embodiment, the clip 110 includes a second pair of legs having a third leg 120 and a fourth leg 121. The third leg 120 and fourth leg 121 have the same structure and manner of operation as the first leg 11 and second leg 112. Namely, the third leg 120 and fourth leg 121 are substantially parallel to one another and attached to one another at one end and unattached at the opposite end thereof. At the unattached end of a preferred embodiment, one of the third leg 120 and fourth leg 121 has a taper 113*b* while the other of the third leg 120 and fourth leg 121 has a taper 113*b* and is also formed into a catch or tang 114*b* at this unattached end. The tapers 113*b* facilitate sliding the legs 120, 121 over a portion of clothing on which the mount 100 is desired to be mounted.

In a preferred embodiment, the first pair of legs 111, 112 is substantially parallel to the second pair of legs 120, 121. Additionally in such an embodiment, the first pair of legs 111, 112 is attached to the second pair of legs 120, 121.

As can be seen in FIGS. 12-17 and 19-21, the pivot assembly 130 preferably comprises two opposed brackets 131*a*, 131*b* that each extend from the vicinity of the attached ends of the legs 111, 112, 120, and 121, a fixed adjustment ring 133*a*, 133*b* residing in each of the two pivot brackets 131*a*, 131*b*, and a pivot pin 134 having a head 135 at one end and threads 136 at the opposite end thereof for receipt of a threaded nut 137. Each fixed adjustment ring 133*a*, 133*b* has radially spaced, alternating ridges 138*a*, 138*b* and valleys 139*a*, 139*b* that operate in concert with opposing radially spaced, alternating valleys 139*d*, 139*c* and ridges 138*d*, 138*c* located in rotatable adjustment rings 153*a* and 153*b* which reside in mounting arms 151*a*, 151*b* that extend from the docking base.

These alternating ridges 138*a*, 138*b*, 138*c*, 138*d* and valleys 139*a*, 139*b*, 139*c*, 139*d* collectively control the orientation of the docking base 30. In a preferred embodiment, each fixed adjustment ring 133*a*, 133*b* and each rotatable adjustment ring 153*a*, 153*b* has twelve ridges 138*a*, 138*b*, 138*c*, 138*d* evenly spaced at thirty degree intervals around each ring 133*a*, 133*b*, 153*a*, 153*b* and twelve valleys 139*a*, 139*b*, 139*c*, 139*d* evenly spaced at thirty degrees between each ridge 138*a*, 138*b*, 138*c*, 138*d*.

The pair of opposed mounting arms 151*a*, 151*b* are spaced apart from one another with their adjustment rings 153*a*, 153*b* rotatably mounted on the pivot pin 134 and in contact with the cooperatively configured fixed adjustment rings 133*a*, 133*b*. The rotatable adjustment rings 153*a*, 153*b* are biased against the fixed adjustment rings 133*a*, 133*b*, such as by a helical spring 152 mounted about the pivot pin 134 and outwardly biasing the two somewhat resilient mounting arms 151*a*, 151*b*. The docking base 30, which extends from the mounting arms 151*a*, 151*b*, is shown and described in parent U.S. patent application Ser. No. 11/331,779, which description is repeated above.

The radially spaced, alternating ridges 138*c*, 138*d* and valleys 139*c*, 139*d* of the rotatable adjustment rings 153*a*, 153*b* face and engage the corresponding radially spaced, alternating valleys 139*a*, 139*b* and ridges 138*a*, 138*b* located in the fixed adjustment rings 133*a*, 133*b*. The rotatable adjustment rings 153*a*, 153*b* in the mounting arms 151*a*, 151*b* are held relatively tightly against the fixed adjustment rings 133*a*, 133*b* in the pivot brackets 131*a*, 131*b* by virtue of the action of the spring 152 pressing outwardly on the mounting arms 151*a*, 151*b* and by virtue of the amount of interference fit between the fixed adjustment rings 133*a*, 133*b* and the rotatable adjustment rings 153*a*, 153*b*.

The orientation of the docking base 30 can be adjusted by the user with or without a light body 50 mounted on the docking base 30 and with or without the mount 100 mounted onto an article of clothing. To adjust the orientation in this regard, the user preferably uses a hand to pivot the docking base 30 about the pivot pin 134 until the desired orientation is achieved. The amount of force with which the ridges 138*c*, 138*d* and valleys 139*c*, 139*d* of the rotatable adjustment rings 153*a*, 153*b* are pushed into the valleys 139*a* and ridges 138*a* of the fixed adjustment rings 133*a*, 133*b* is of such a degree that the selected orientation is not likely to be accidentally changed, even when a user is running or jumping.

In a preferred embodiment, as the rotatable adjustment rings 153 are rotated, the valleys 138 and ridges 139 of the rotatable adjustment rings 153 automatically snap into the next ridges 139 and valleys 139 of the fixed adjustment rings 133. Even when neither of the user's hands are free, the user can still quickly and easily adjust the orientation by pressing on the docking base 30 or the light body 50 with any handheld object or other object.

A light body 50 such as shown in FIGS. 2, 7, 11, 22, 23, 24, and 25 is removably securable to the docking base 30. The light body 50 is shown and described in detail in parent U.S. patent application Ser. No. 11/331,779, which description is repeated above.

Specifically, the docking base 30 includes a first attachment device for cooperating with a second attachment device on the light body 50, for quickly and rigidly installing the light body 50 on the docking base 30 and for quickly removing the light body 50 therefrom. In the preferred embodiment, the docking base attachment device includes an attachment guide 32, an attachment channel 34, and a quick-release latching lever 36 with latch 38 and quick-release button 40.

The preferred attachment device of the light body 50, for rigidly attaching the light body 50 to the docking base 30, includes an attachment rail 52 on the light body 50 that engages the attachment channel 34 in the docking base 30. The attachment rail 52 comprises two parallel attachment rails 52*a* and 52*b* that are joined together at one end with a continuous U-shaped rail 52*c* and that are open at their other end.

The attachment channel 34 comprises two parallel attachment channels 34*a* and 34*b* joined together at one end with a continuous U-shaped channel 34*c* and that are closed at their other end. Once the attachment rails 52 are fully engaged with the attachment channels 34, the light body 50 is held in full engagement by the latch 38 that automatically engages a catch or slot 54 in the light body 50. Once the latch 38 has automatically engaged the slot 54, the light body 50 is in locked engagement with the docking base 30.

In the preferred embodiment, the light body 50 has a visible light source 56, e.g., a high luminous flux LED, a night vision light source 58, e.g., an invisible infrared LED or a visible red LED, and an IFF light source 60. A single three-position toggle switch 62 typically controls the visible light source 56 and the night vision light source 58. A separate switch 64 typically controls the IFF light source 60.

In addition to an assault vest such as a MOLLE vest, the mount 100 can be secured to other articles of clothing such as belts, jackets, shirts, pants, headgear, straps, bands, waistbands, footwear and the like. An individual can readily install the mount 100 on any of these articles of clothing by simply pushing the legs 111, 112 over an edge of an article of clothing or by fastening the clip 10 to the article of clothing. Once the mount 100 is installed on an article of clothing in this manner, the user can readily install the light body 50 on, or remove the light body 50 from, the docking base 30 in a substantially continuous one-handed motion. An individual can complete such installation and removal of the light body 50 in total darkness without the need to make any visual contact with the light body 50 or the clothing.

The manner of installing and removing the light body 50 onto and from the docking base 30 is described in detail in parent U.S. patent application Ser. No. 11/331,779, which description is repeated above.

Specifically, to install the light body 50 on the docking base 30, the light body 50 may be held in one hand and the attachment rails 52 are aligned with the attachment channels 34. The battery housing 90 may assist the user in orienting the light body 50 so that the attachment rails 52 are roughly aligned with the attachment channels 34.

The U-shaped guide 32*c* of the attachment channels 34 acts as an automatic self-centering mechanism to ensure easy engagement of the attachment rails 52 with the attachment channels 34. This U-shaped guide 32*c* is large enough so that a user can locate it by feel with a single hand and without the need for visual reference or assistance.

Once the user aligns the attachment rails 52*a*, 52*b* with the attachment channels 34*a*, 34*b*, the light body 50 can then be installed on the docking base 30 by simply pushing the light body 50 toward the quick-release button 40 until the light body 50 can be pushed no further. The light body 50 is stopped from making contact with the quick-release button 40 because the attachment rails 52 are prevented from further movement by the presence of the U-shaped attachment rail 52*c* coming into contact with the U-shaped attachment channel 32*c*. The light body 50 is further stopped from making contact with the quick-release button 40 because the attachment rails 52 are prevented from further movement by the presence of the closed end of the attachment channels 32*a* and 32*b*. As the light body 50 reaches this position, the light body 50 trips the latch 38 of the resilient latch lever 36 to engage the catch or slot 54, automatically and releasably locking the light body 50 to the docking base 30.

As previously noted, the latch 38 and quick-release button 40 are both located on the quick-release latching lever 36 that is part of the docking base 30. The quick-release lever 36 is resilient so that when the quick-release lever 36 is operated, the quick-release lever 36 automatically returns toward the position it was in prior to being actuated. The latch 38 is tapered so that as the light body 50 is pushed onto the docking base 30, the light body 50 moves across the taper of the latch 38 thereby displacing the latch 38.

When the light body 50 reaches the point where the attachment rails 52 fully engage the attachment channels 34, the catch or slot 54 on the light body 50 is then in a position such that the latch 38 automatically springs into engagement with the slot 54. This engagement keeps the light body 50 rigidly attached to the docking base 30. The taper of the latch 38 and the raised position of the latch 38 in its normal state can be seen in FIGS. 13-15.

The latch 38 is disengaged from the slot 54 by depressing the quick-release button 40 and simultaneously sliding the light body 50 in a direction away from the quick-release button 40. Depressing the quick-release button 40 causes the latch 38 to move away from the catch or slot 54 until the latch 38 is completely clear of the catch or slot 54. At this point, the light body 50 can be pulled free and clear of the docking base 30.

Figure 14:
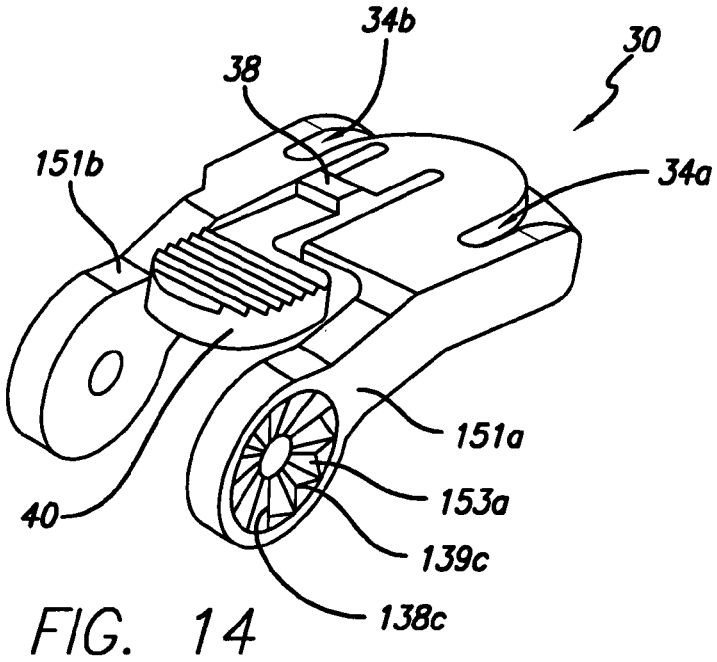
Figure 14A:
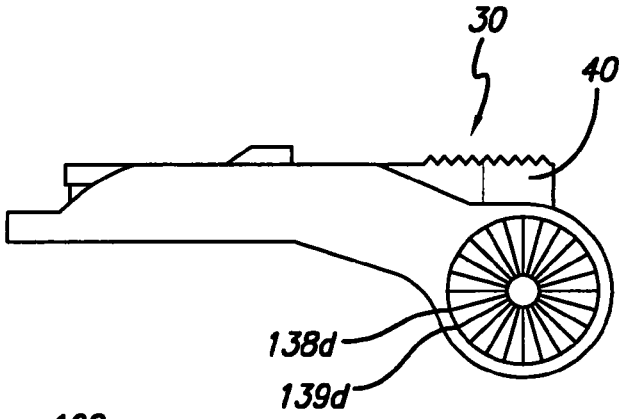
FIG. 14*a* is a side view of the docking base, mounting arms, and rotatable adjustment ring shown in FIG. 14.
Figure 15:
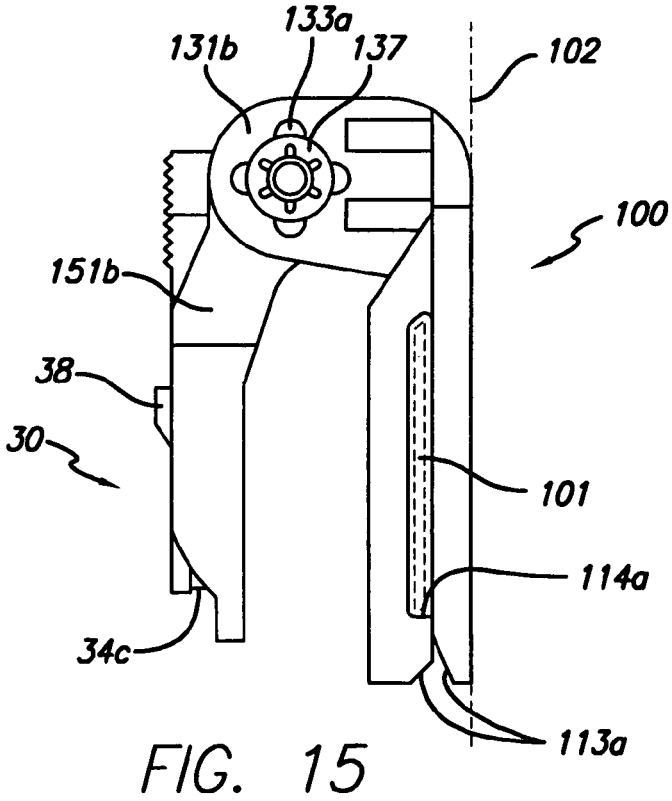
Figure 16:
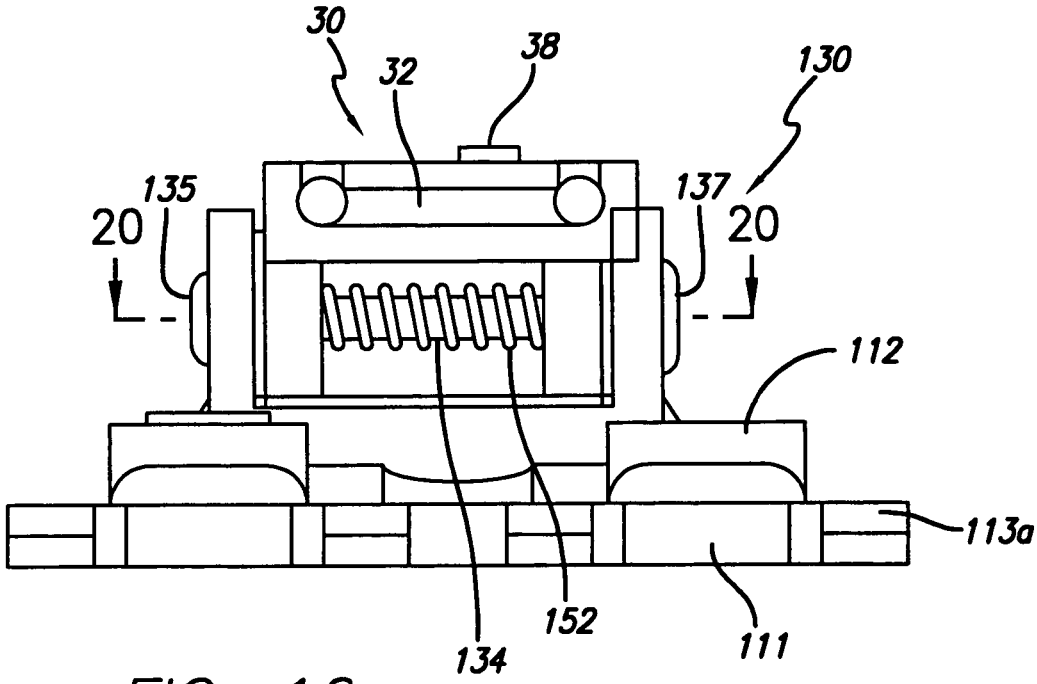
Figure 17:
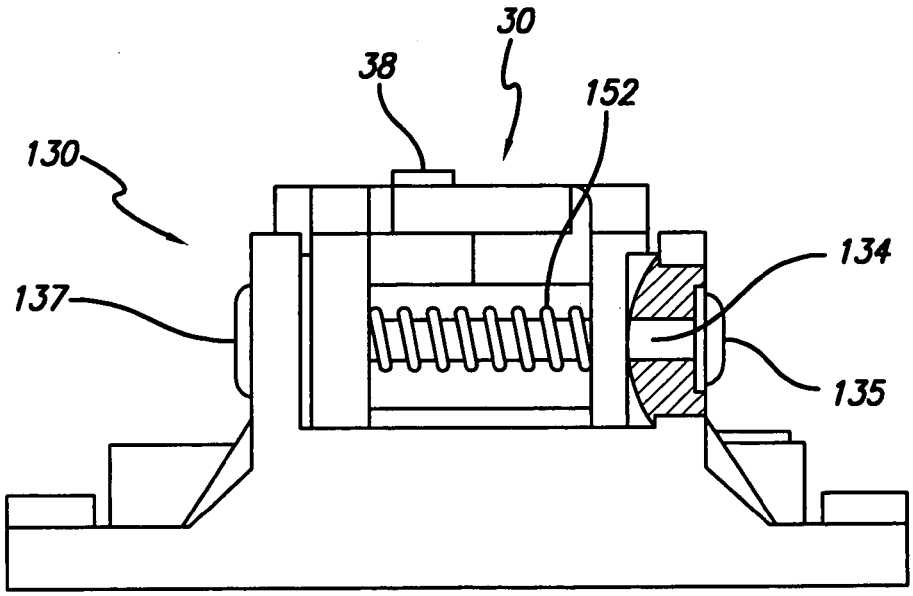
Figure 18:
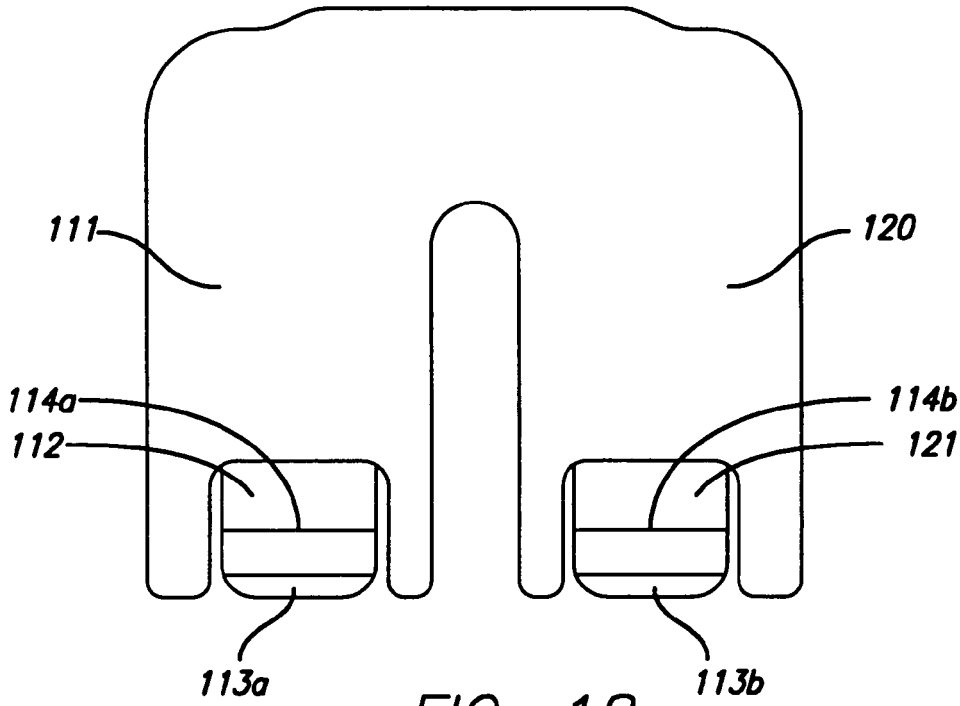
Figure 19:
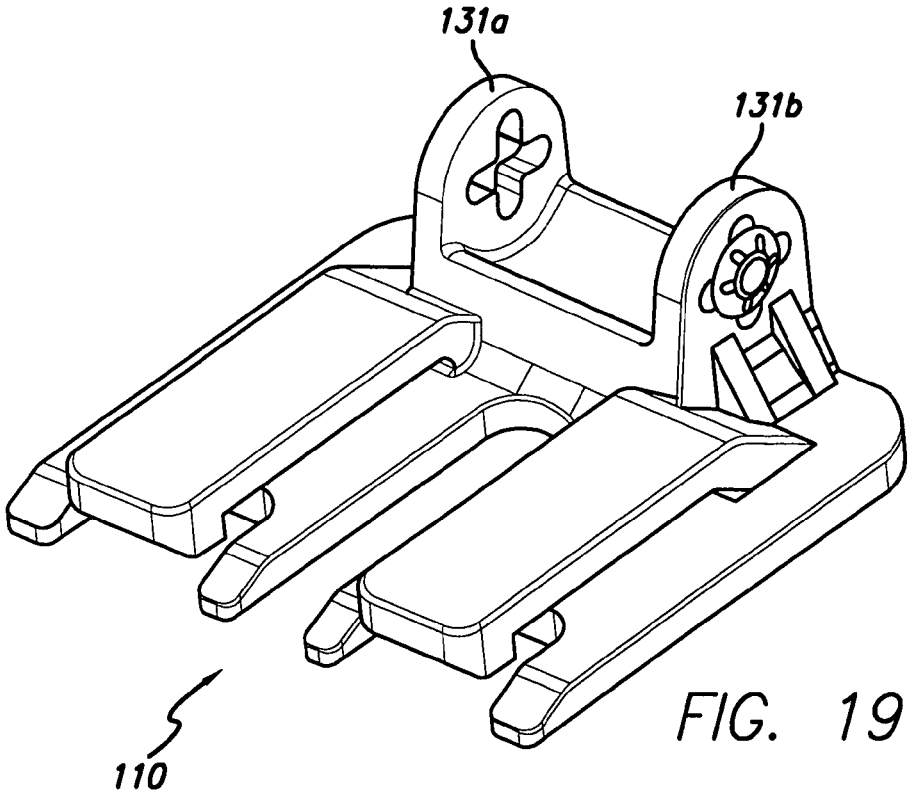
Figure 20:
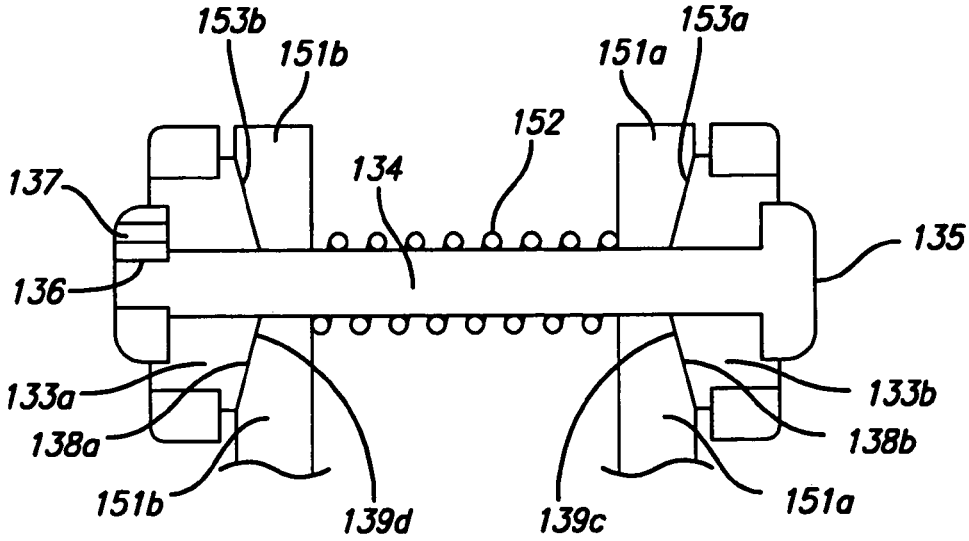
Figure 21:
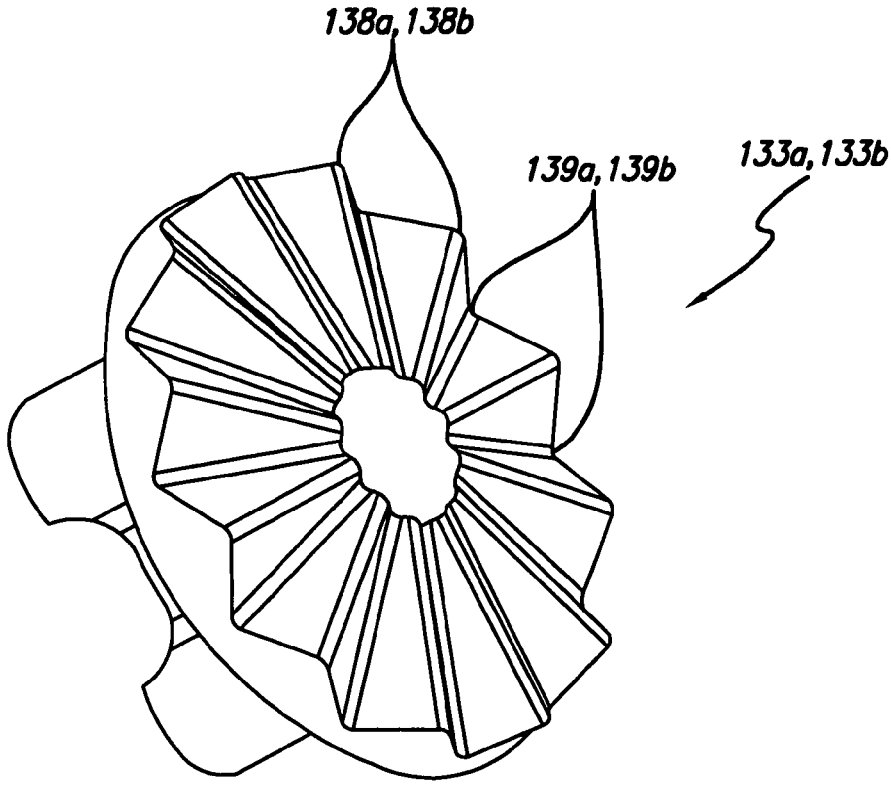
Figure 22:
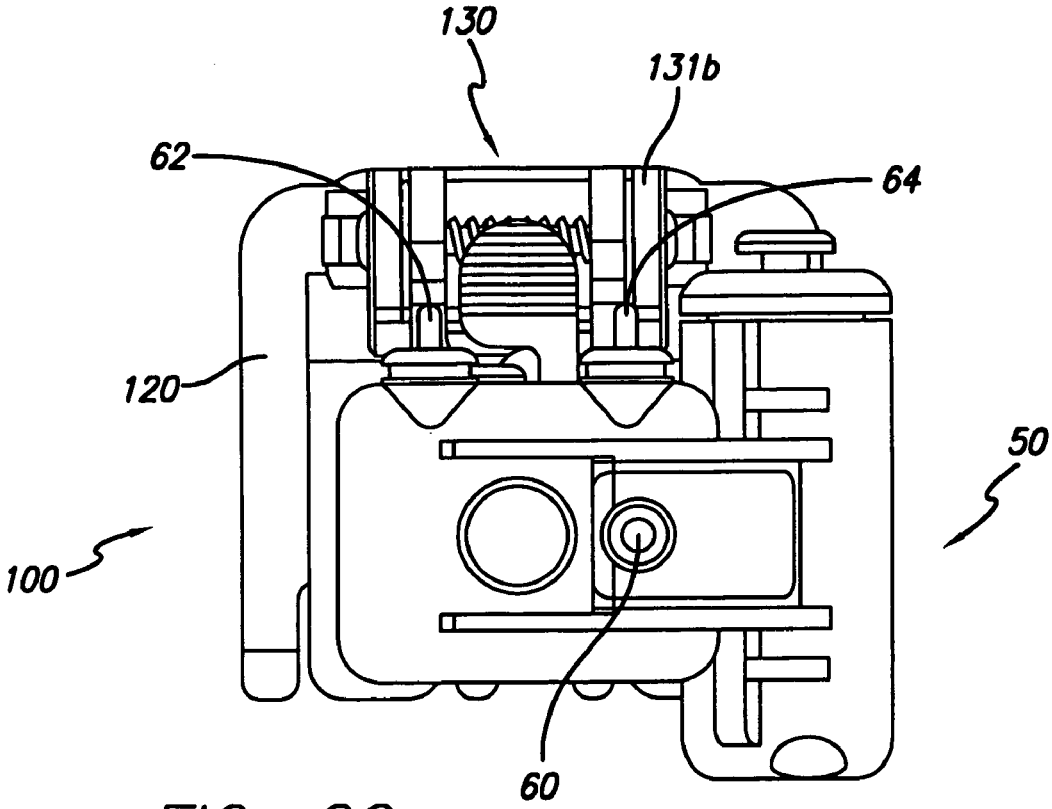
Figure 23:
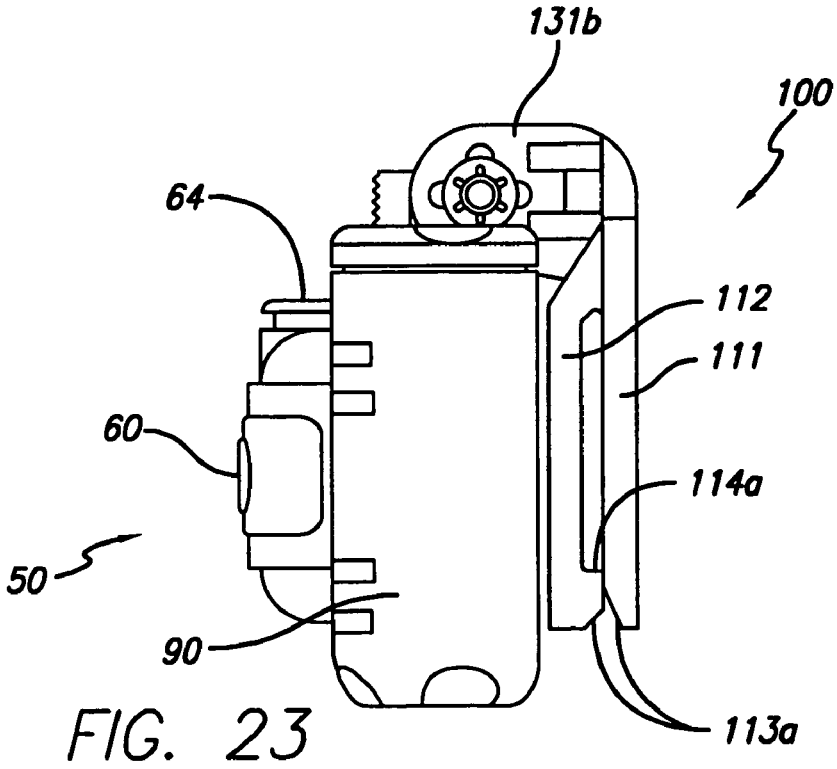
Figure 24:
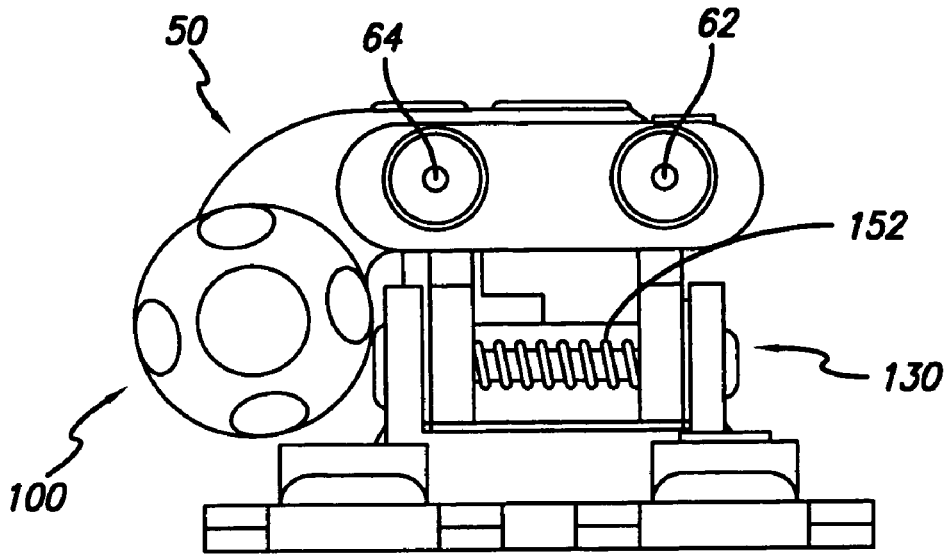
Figure 25:
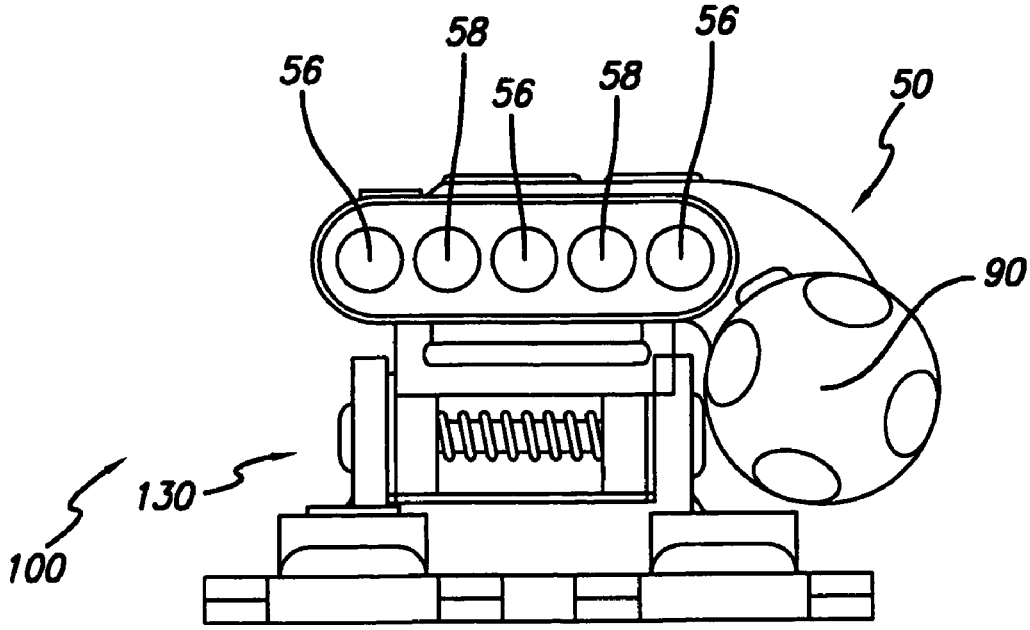
Figure 26:
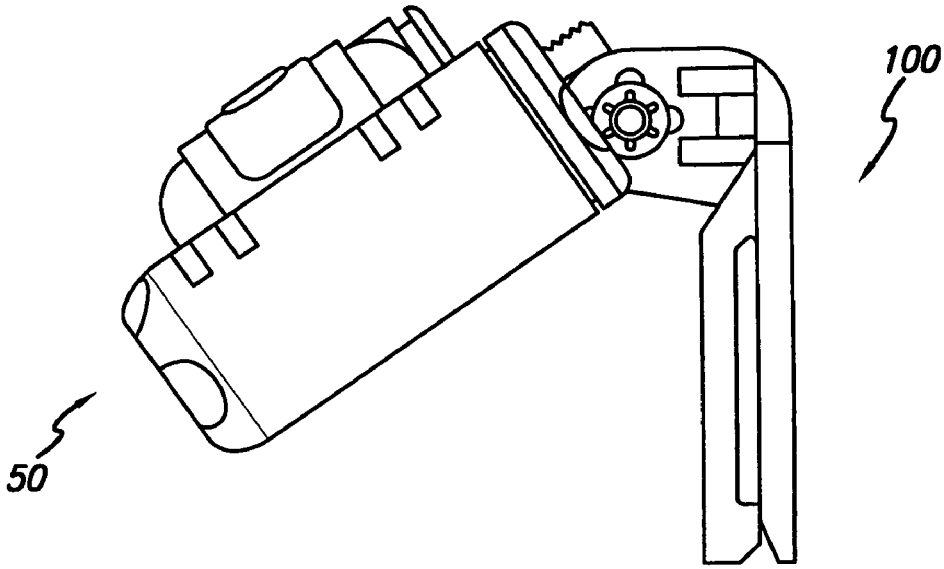
Figure 27:
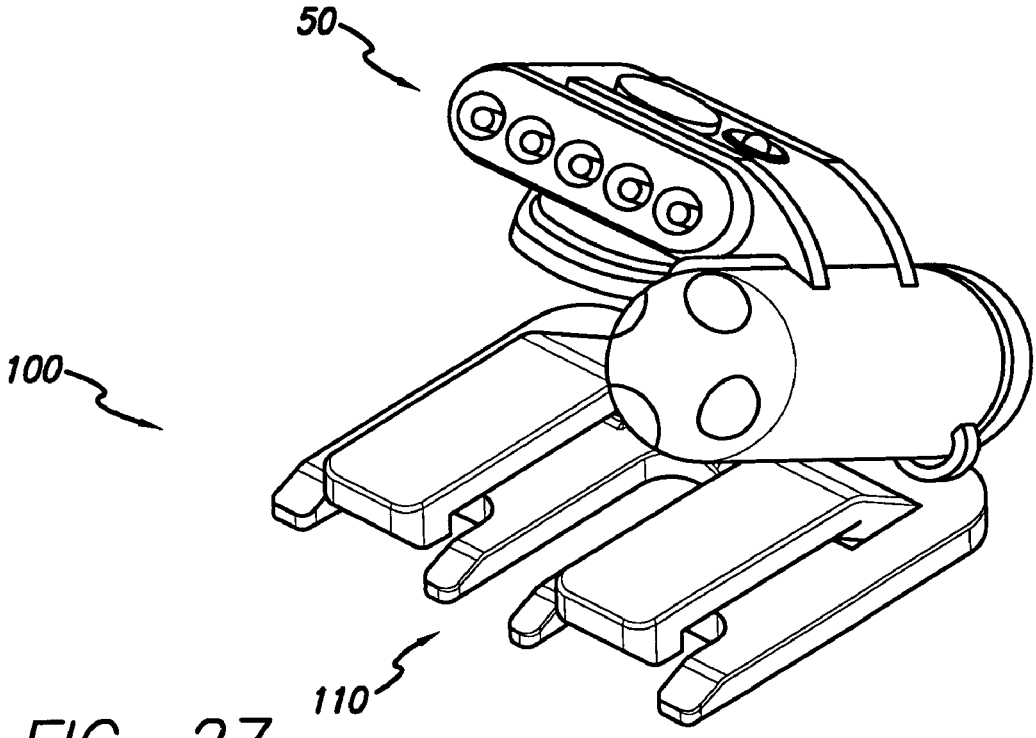
Figure 28:
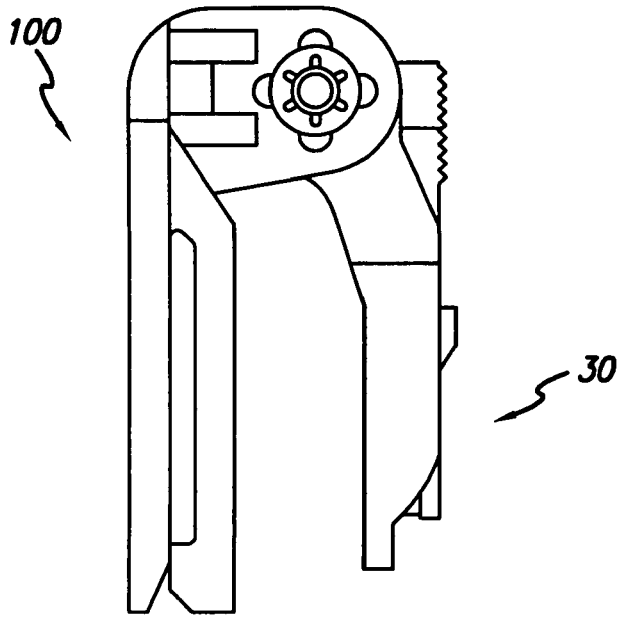
Figure 29:
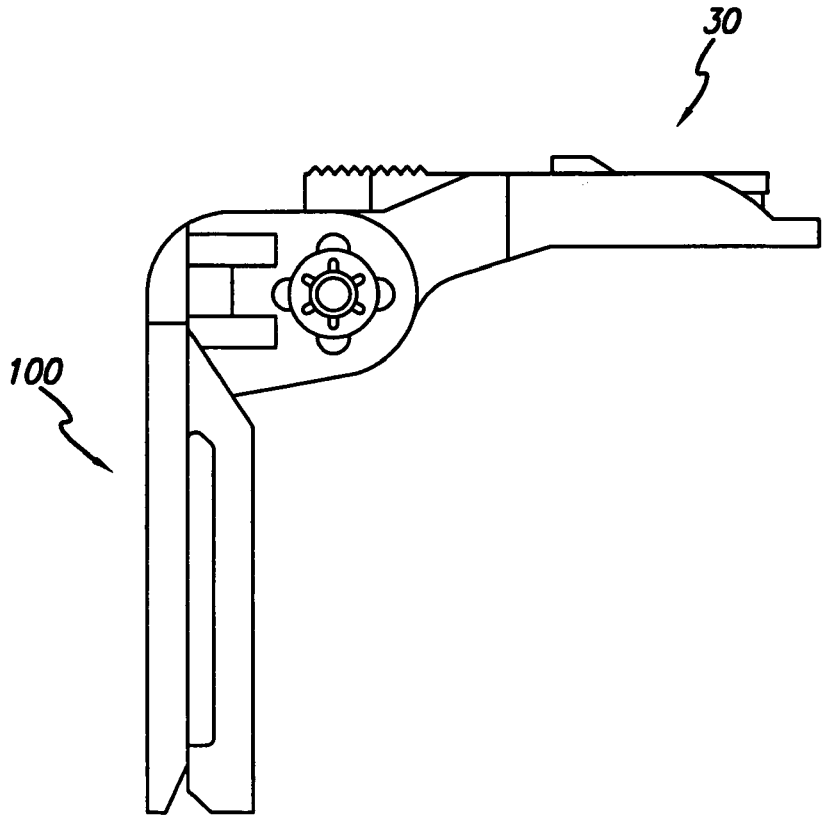
Figure 30:
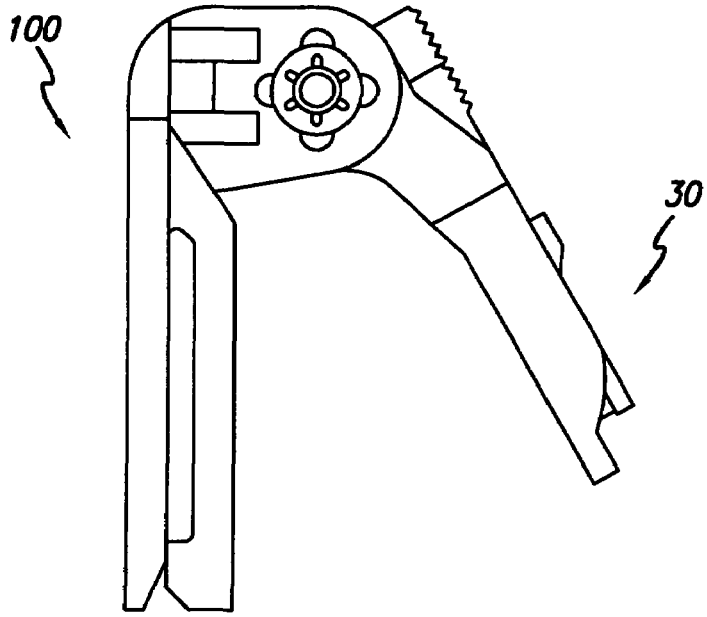
Figure 31:
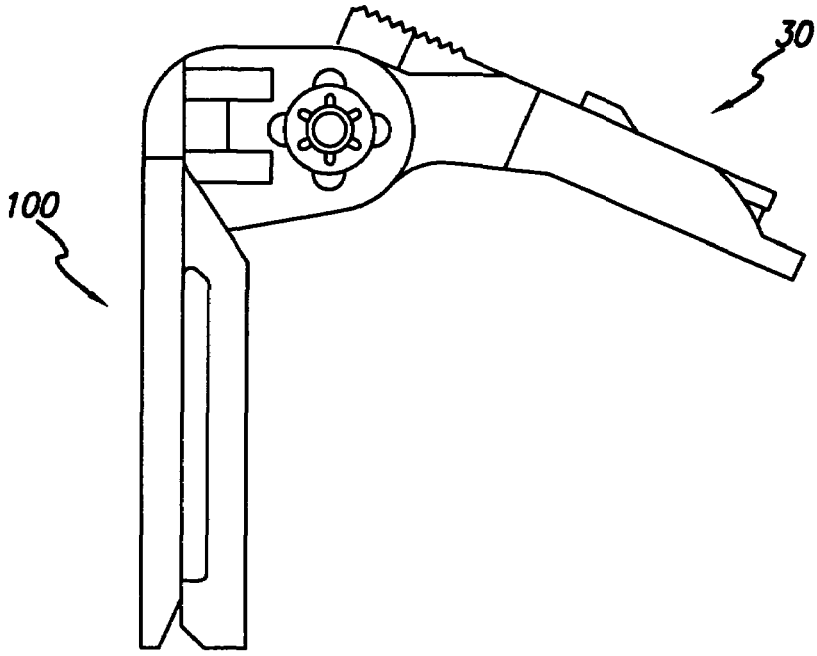

The location of the quick-release button 40 with respect to the light body 50 is best seen in FIG. 14. It may be appreciated that, to remove the light body 50 from the docking base 30 when the mount 100 is secured to an article of clothing as in FIG. 11, the user may grasp the light body 50 with one hand while, with the thumb or finger of the same hand, simultaneously depress the quick-release button 40 and slide the light body 50 along the channels 34*a*, 34*b* of the docking base 30 away from the button 40 until the light body 50 is removed from the docking base 30.

The foregoing description is for illustrative purposes only. It will be apparent to those skilled in the art that various changes and modifications can be made to the instant invention without departing from the overall spirit and scope of the instant invention. It is in that context that the following claims are made.

What we claim as our invention is:

1. A mount assembly for mounting a light body to an article of clothing, comprising:

a clip including at least one pair of legs removably attachable to an article of clothing;

a pivot assembly including two opposed brackets secured to said clip, two fixed adjustment rings respectively in said brackets, and a pivot pin extending between said fixed adjustment rings;

a docking base for lockably engaging the light body, said docking base including two opposed arms each including an adjustment ring cooperatively configured to said fixed adjustment rings and pivotally mounted to said pivot pin; and a spring carried by said pivot pin biasing said arms away from one another.

2. The mount assembly according to claim 1, wherein:

said clip includes two pairs of legs.

3. The mount assembly according to claim 1, wherein:

the article of clothing includes a strap; and said at least one pair of legs is removably attachable to the strap.

4. The mount assembly according to claim 3, wherein:

the article of clothing comprises an assault vest.

5. The mount assembly according to claim 3, wherein:

the article of clothing comprises a vest including the strap.

6. Light apparatus for attachment to an article of clothing, comprising:

a clip for being removably attached to the article of clothing;

a pivot assembly including two opposed brackets secured to said clip, two fixed adjustment rings respectively in said brackets, and a pivot pin extending between said fixed adjustment rings;

a docking base including two opposed arms each including an adjustment ring cooperatively configured to said fixed adjustment rings and pivotally mounted to said pivot pin;

a spring carried by said pivot pin biasing said arms away from one another;

a light body including at least one light source;

two spaced-apart parallel channels in one of said docking base and said light body; and two spaced-apart parallel rails on the other one of said docking base and said light body, said two parallel rails alignable with said two parallel channels and slidably engagable therealong for attaching said light body to said docking base.

7. The light apparatus according to claim 6, including:

a U-shaped channel joining said two parallel channels; and a U-shaped rail joining said two parallel rails, said U-shaped rail complementary to said U-shaped channel for engagement therewith.

8. The light apparatus according to claim 6, wherein:

said rings of said docking base each includes a plurality of radially spaced ridges and valleys, said rings of said pivot assembly each includes radially spaced valleys and ridges engaging said ridges and valleys of said rings of said docking base.

9. The light apparatus according to claim 7, wherein:

said two parallel channels and said U-shaped channel are in said docking base; and said two parallel rails and said U-shaped rail are on said light body.

10. Light apparatus according to claim 7, wherein:

said docking base and said light body are adapted for automatically locking said light body to said docking base with said U-shaped rail engaging said U-shaped channel and with said two parallel rails engaging said two parallel channels.

11. The light apparatus according to claim 10, wherein:

said docking base includes an actuator for releasing said light body from said docking base when actuated.

12. Light apparatus according to claim 7, wherein:

said pivot assembly secures said docking base to said clip for engaging said docking base in a selected one of a plurality of alternative fixed orientations with respect to said clip.

13. The light apparatus according to claim 7, wherein:

said clip includes at least one pair of legs.

14. The light apparatus according to claim 13, wherein:

one leg of said at least one pair of legs includes a catch directed toward the other leg of said at least one pair of legs.

15. The light apparatus according to claim 13, wherein:

an end of one leg of said at least one pair of legs is tapered toward the other leg of said at least one pair of legs.

16. The light apparatus according to claim 7, wherein:

the article of clothing comprises an assault vest.

17. The light apparatus according to claim 7, wherein:

the article of clothing comprises a vest including a strap.

18. The light apparatus according to claim 7, wherein:

the article of clothing comprises a strap.

19. The light apparatus according to claim 18, wherein:

said clip includes a pair of legs having a catch on one of said legs for capturing a portion of the strap between said legs of said pair of legs.

* * * * *

UNITED STATES PATENT AND TRADEMARK OFFICE

CERTIFICATE OF CORRECTION

PATENT NO. : 7,549,763 B2
APPLICATION NO. : 11/594504
DATED : June 23, 2009
INVENTOR(S) : Paul Y. Kim, Travis S. Mitchell and Laichang Tang It is certified that error appears in the above-identified patent and that said Letters Patent is hereby corrected as shown below:

At column 8, line 60, "first leg 11" should be --first leg 111--.
At column 10, line 50, "clip 10" should be --clip 110--.
Column 12, lines 1-2 should read as follows: --a clip including at least one pair of legs for being removably attached to the article of clothing;--.

Signed and Sealed this

Eighteenth Day of August, 2009

David J. Kappos

David J. Kappos
*Director of the United States Patent and Trademark Office*